US007739880B2

(12) United States Patent
Okamoto et al.

(10) Patent No.: US 7,739,880 B2
(45) Date of Patent: Jun. 22, 2010

(54) COMPRESSOR AND AIR CONDITIONER

(75) Inventors: Fukukou Okamoto, Kusatsu (JP); Kazuhiro Nawatedani, Kusatsu (JP); Kengo Murayama, Kusatsu (JP); Takayuki Matsumoto, Kusatsu (JP); Tetsuya Itagaki, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 947 days.

(21) Appl. No.: 11/522,513

(22) Filed: Sep. 18, 2006

(65) Prior Publication Data

US 2008/0066478 A1 Mar. 20, 2008

(51) Int. Cl.
*F25D 21/00* (2006.01)

(52) U.S. Cl. ..... 62/151; 62/80

(58) Field of Classification Search ..... 62/80, 62/150, 151, 152; 417/222.2, 270
See application file for complete search history.

(56) References Cited

U.S. PATENT DOCUMENTS 6,481,977 B2 * 11/2002 Mameda et al. ..... 417/222.2
6,703,828 B2 * 3/2004 Babin et al. ..... 324/207.25

FOREIGN PATENT DOCUMENTS

JP 2000-197385 A 7/2000
JP 2004-124948 A 4/2004
JP 2004-132282 A 4/2004
JP 2006194097 A * 7/2006

* cited by examiner

*Primary Examiner*—Marc E Norman
(74) *Attorney, Agent, or Firm*—Global IP Counselors

(57) ABSTRACT

There is provided a compressor and an air conditioner capable of preventing a piston from being locked to a cylinder by iced matters. A compressor operation control section 18 of a control unit 20 stops the piston 2 in a high-temperature region HR of comparatively high temperatures where frost or ice of an inner circumferential surface of the cylinder 1 is less easily generated. As a result, generation of iced matters between the high-temperature region HR of the inner circumferential surface of the cylinder 1 and the piston 2 is prevented, so that a lock of the piston 2 due to iced matters can be prevented.

26 Claims, 23 Drawing Sheets

Vsp : SET VOLTAGE FOR NORMAL START-UP
OCP : OVER CURRENT PROTECTOR

Vtup : PRESET VOLTAGE VALUE SUITABLE FOR HIGH LOAD TORQUE (OR ITS EQUIVALENT VALUE)

Ttup : Vtup RETENTION TIME

Vocp : VOLTAGE VALUE UNDER OPERATION OF OCP (OR ITS EQUIVALENT VALUE)
Vocp' : VOLTAGE VALUE OF SET VOLTAGE FINE ADJUSTED TO LOWER SIDE WITH RESPECT TO Vocp (OR ITS EQUIVALENT VALUE)
Vd : VALUE FOR FINE ADJUSTMENT OF VOLTAGE (Vocp'=Vocp−Vd)

Tr : TIME INTERVAL BETWEEN ONE LOCK DECISION AND ANOTHER

COMPRESSOR AND AIR CONDITIONER

BACKGROUND OF THE INVENTION

The present invention relates to an compressor and an air conditioner.

As a compressor, there has conventionally been a swing type compressor in which a cylinder chamber formed in a cylinder is divided into a compression chamber and a suction chamber by a piston and a blade which are integrally formed, the blade being swingably held by two semicolumnar-shaped bushings, where a discharge port is opened in the compression chamber while a suction port is opened in the suction chamber (JP 2004-124948 A).

In this swing type compressor, refrigerant gas is sucked into the suction chamber through the suction port by swing motion of the piston with the blade serving as a fulcrum, and the refrigerant gas is compressed by the compression chamber and discharged through the discharge port.

In this connection, it is known that the conventional swing type compressor becomes worse in starting performance under a low outside air temperature in winter. It is further known that a rotor type compressor in which a piston and a blade are provided independently of each other and in which the piston slides against the blade also becomes worse in starting performance in winter.

It is considered heretofore that the worsening of the starting performance in winter in this type of swing type compressor is attributed to increases of the viscosity of refrigerating machine oil or to the so-called liquid compression that the refrigerant liquid is compressed within the compressor. As measures therefor, it has been practiced to heat the compressor by a heater before occurrence of the worsening of starting performance under such conditions as the liquid compression would occur or the viscosity would decrease.

However, the present inventor found that even with these measures, unidentifiable starting failures would occur to compressors in winter. Particularly, a compressor that has come to into such a starting failure, if carried in and disassembled in a service center, would be impossible to find any abnormalities therein and, if installed at field once again, would start up normally, where repeatability of the starting failure could not be recognized.

SUMMARY OF THE INVENTION

Accordingly, an object of the present invention is to provide a compressor capable of preventing occurrence of starting failures that are unidentifiable and less repeatable as described above.

In order to investigate the cause of occurrence of such starting failures in compressors as described above, the present inventor performed analyses and presumptions as to the mechanism of occurrence of starting failures as follows.

First, upon occurrence of a starting failure, a compressor was immediately disassembled. That is, a swing type compressor that had come into a starting failure was disassembled immediately after the starting failure at the field without being carried in to a service center. Then, as shown in FIG. 1, we discovered that the compressor had a piston 2 locked to a cylinder 1 by iced matters 3 so that the compressor was unrotatable.

In this case, operation conditions at the time of occurrence of the starting failure were as follows. An air conditioner having the compressor was operated in a defrost operation for several minutes, showing that the temperature of the inhaled gas of the compressor in the defrost operation was 0 to −30° C. After the defrost operation, the compressor was kept in rest of heating operation for several tens of minutes to several hours, and then restarted. In this case, the compressor showed a starting failure. On the other hand, even with 0 to −30° C. inhaled gas temperatures of the compressor in defrost operation, when the compressor was keep in rest of heating operation for several minutes, e.g. 3 minutes, after the defrost operation, the compressor started up without any problem.

Immediately before an end of defrost operation, the temperature inside the compressor and the temperature of the indoor heat exchanger become the lowest, while both temperatures increase after an end of the defrost operation. However, although heating operation immediately after an end of defrost operation (after an about several minutes of rest) was restarted with no problem, yet a starting failure due to iced matters occurred when the compressor was restarted after an elapse of several tens of minutes after an end of defrost. This means that no starting failure of the compressor occurs under low temperatures immediately after an end of defrost, while a starting failure occurs under high temperatures after an elapse of several tens of minutes after an end of defrost.

This observation seemingly suggests that iced matters, which, it could be considered, are generated more and more with decreasing temperatures, have no relation to starting failures. However, the present inventor conceived that moisture in the refrigerant gas frosts and freezes on wall surfaces of the cylinder chamber of the compressor because of decreases of the internal temperature of the compressor in defrost, after which the iced matters are grown inside the cylinder to a high density by time elapse and temperature changes (including increases), with the result that the piston is locked to the cylinder.

That is, more specifically, we inferred the mechanism in which frosts and ices are grown inside the cylinder chamber so as to be increased in density and solidified as follows:

(i) In the cylinder chamber in which the piston is rotating even with temperatures decreased to −30° C. during defrost operation, moisture in the refrigerant gas is suspended in the form of fine ice particles (like ice crystals that are nuclei of snow), part of the fine ice particles being deposited on the wall surfaces of the cylinder chamber and the outer surfaces of the piston. These deposited fine ice particles, as shown in FIG. 2A, are pressed and crushed against the wall surfaces of the cylinder chamber of the cylinder 1 by the swinging or rotating piston 2, by which a solidified frost or ice layer (iced matters) 3 is generated. This solidified frost or ice layer 3 is deposited to several tenths (several μm to several tens of μm) of a clearance positioned at a site where a wall surface of the cylinder chamber 5 and the outer peripheral surface of the piston 2 come to the closest, i.e., between an inner surface of the cylinder chamber and the piston at a contact point. In this stage, however, no starting failure occurs.

(ii) After a stop of operation, the pressed and solidified frost or ice layer 3 deposited on metal surfaces of the cylinder and the piston under a low temperature decreased to −30° C. is supplied with moisture primarily due to the internal diffusion as shown in FIG. 2B, further growing thicknesswise (voids between crystals are large at this time point).

(iii) Thereafter, as shown in FIG. 2C, ambient moisture is supplied to the voids of the grown frost or ice crystals 3, so that the frost or ice density goes higher. However, at this time point, the bonding strength between the frost or ice crystals 3 is not so large. Therefore, no starting failure of the compressor occurs in this state.

(iv) Further, the saturation temperature increases together with increasing internal pressure of the cylinder chamber by equalization of high and low pressures of the refrigerant circuit after the operation stop. As a result, the ambient temperature of the frost or ice increases, so that tip portions (including frost interiors) of the frost or ice crystals are melted, penetrating inside the frost or ice, with the frost density further increased. Moreover, on condition that the ambient temperature is near the melting point, the frost density also increases by a sintering phenomenon of the frost. As a result, as shown in FIG. 2D, the frost or ice crystals 3 are ultimately increased in density and frozen, leading to a starting failure of the compressor.

The present invention has been accomplished based on the above-described analyses and presumptions as to the mechanism of occurrence of starting failures.

According to the present invention, there is provided a compressor body in which a cylinder chamber formed in a cylinder is divided into a compression chamber and a suction chamber by a piston and a blade, the compression chamber having a discharge port opened and the suction chamber having a suction port opened;

a motor for driving the piston; and an icing-lock preventing section for preventing a lock of the piston due to iced matters generated and grown between an inner surface of the cylinder chamber and the piston.

In the compressor of this invention, a lock of the piston due to iced matters generated and grown between the inner surface of the cylinder chamber and the piston can be prevented by the icing-lock preventing section.

In one embodiment, the piston and the blade are integrally fixed, and the piston is a swing type one which works in swing motion.

In this embodiment, even with a swing type compressor in which one side of the piston normally faces a lower-temperature side of the cylinder so as to be liable to lock due to iced matters, a lock of the compressor body can be prevented by the icing-lock preventing section.

In one embodiment, the icing-lock preventing section includes a crystal growth inhibiting section for inhibiting growth of frost or ice crystals generated within the cylinder chamber.

In this embodiment, growth of crystals of iced matters can be inhibited by the crystal growth inhibiting section, so that a lock of the piston due to iced matters can be prevented.

In one embodiment, the crystal growth inhibiting section includes:

an operation-stopped state deciding section for deciding whether or not operation of the compressor body has been stopped in an elapse of a specified time after a stop of defrosting operation of an air conditioner; and a following-operation-of-compressor control section for, when it is decided by the operation-stopped state deciding section that operation of the compressor body has been stopped, controlling the motor so that the compressor body is forcedly operated for a specified time.

In this embodiment, the operation-stopped state deciding section decides whether or not operation of the compressor body has been stopped in an elapse of a specified time after a stop of defrosting operation of the air conditioner. That is, the operation-stopped state deciding section decides whether or not a condition under which iced matters are grown to lead to a lock is satisfied. Then, when it is decided by the operation-stopped state deciding section that operation of the compressor body has been stopped, i.e. that the condition for a lock due to iced matters is satisfied, the following-operation-of-compressor control section controls the motor so that the compressor body is forcedly operated for a specified time. Therefore, it becomes possible to keep the compressor in operation to inhibit the growth of iced matters while the condition for iced matters to be grown solid is satisfied, and to keep the compressor out of operation while the condition for iced matters to be grown solid is not satisfied.

An air conditioner of one embodiment comprises a refrigerant circuit in which the compressor, a four-way switching valve, an indoor heat exchanger, an expansion section, an outdoor heat exchanger, the four-way switching valve and the compressor are connected in order to one another; and a following-operation-of-air-conditioner control section for, while the following-operation-of-compressor control section is working for following operation of the compressor, controlling the four-way switching valve so as to perform heating operation and controlling at least a fan of the indoor heat exchanger to stop the fan.

In this embodiment, the following-operation-of-air-conditioner control section, while the following-operation-of-compressor control section is working for following operation of the compressor, controls the four-way switching valve so as to perform heating operation and controls at least the fan of the indoor heat exchanger to stop the fan. Therefore, while the compressor is working for following operation, growth of the iced matters can be inhibited by supplying the high-temperature refrigerant gas to the compressor body, and moreover, because at least the fan of the indoor heat exchanger is stopped, the user can be kept from being aware of the following operation. In addition, the following-operation-of-air-conditioner control section may control fans of both the indoor heat exchanger and the outdoor heat exchanger so that both fans are stopped.

In one embodiment, the icing-lock preventing section includes a piston-stop-position control section for controlling a stop position of the piston so that the piston is stopped in a high-temperature region other than low-temperature regions of an inner circumferential surface of the cylinder where frost or ice is easily generated.

In this embodiment, the piston-stop-position control section controls a stop position of the piston so that the piston is stopped in the high-temperature region other than the low-temperature regions of the inner circumferential surface of the cylinder where frost or ice is easily generated. Therefore, frost or ice is less easily generated at contact points between the piston and the cylinder, so that a lock of the piston due to iced matters can be prevented.

In one embodiment, the high-temperature region is a region including a region of the inner circumferential surface of the cylinder between the blade and the suction port, and a region of the inner circumferential surface of the cylinder ranging from 180° to 360° from the blade toward a moving direction of the piston about a center of the cylinder chamber.

In one embodiment, the high-temperature region is a region of the inner circumferential surface of the cylinder ranging from 180° to 360° from the blade toward a moving direction of the piston about a center of the cylinder chamber.

In one embodiment, the low-temperature region is a region of the inner circumferential surface of the cylinder between the suction port and a site of 180° from the blade toward a moving direction of the piston about a center of the cylinder chamber, and the piston-stop-position control section stops the piston in the high-temperature region so that a clearance between the inner circumferential surface of the cylinder and the piston becomes not less than 500 μm in the low-temperature region.

In this embodiment, the piston-stop-position control section stops the piston in the high-temperature region so that the clearance between the inner circumferential surface of the cylinder and the piston becomes not less than 500 μm in the low-temperature region. Therefore, the piston and the cylinder are less easily locked by iced matters in the low-temperature regions.

A compressor of one embodiment comprises a stop instruction deciding section for deciding whether or not a stop instruction for stopping operation of the compressor body has been outputted during defrost operation of the air conditioner or within a specified time after a return to heating operation from the defrost operation, wherein the piston-stop-position control section controls a stop position of the piston, when it is decided by the stop instruction deciding section that the stop instruction has been outputted.

In this embodiment, the stop instruction deciding section decides whether or not a stop instruction for stopping operation of the compressor body has been outputted during defrost operation of the air conditioner or within a specified time after a return to heating operation from the defrost operation. That is, the stop instruction deciding section decides whether or not the condition for iced matters to grow and cause a lock is satisfied. Then, when it is decided by the stop instruction deciding section that the stop instruction has been outputted, i.e. that the condition for iced matters to grow and cause a lock is satisfied, the piston-stop-position control section controls the stop position of the piston. Therefore, it becomes possible to control the stop position of the piston while the condition for iced matters to grow and cause a lock is satisfied, and not to control the stop position of the piston while the condition for iced matters to grow solid is not satisfied.

In one embodiment, the icing-lock preventing section includes:

a starting-lock discriminating section for deciding whether or not the compressor body has locked at a start-up; and a starting-power increasing section for, when it is discriminated by the starting-lock discriminating section that the compressor body has locked, increasing supply power to the motor.

In this embodiment, when it is discriminated by the starting-lock discriminating section that the compressor body has locked, the starting-power increasing section increases supply power to the motor, and forcedly drives the motor. Therefore, a lock of the piston due to iced matters can be prevented In one embodiment, the icing-lock preventing section further includes:

an operation-stopped state deciding section for deciding whether or not operation of the compressor body has been stopped in an elapse of a specified time after a stop of defrosting operation of an air conditioner, and the starting-lock discriminating section decides whether or not the compressor body has locked at a restart, when the operation-stopped state deciding section decides that operation of the compressor body has been stopped.

In this embodiment, the operation-stopped state deciding section decides whether or not operation of the compressor body has been stopped in an elapse of a specified time after a stop of defrosting operation of the air conditioner. That is, the operation-stopped state deciding section decides whether or not the condition for iced matters to grow and cause a lock is satisfied. Then, when the operation-stopped state deciding section decides that operation of the compressor body has been stopped, i.e. that the condition for iced matters to cause a lock is satisfied, the starting-lock discriminating section decides whether or not the compressor body has locked at a restart. Therefore, when the condition for iced matters to grow solid is satisfied, the supply power to the motor can be increased by the starting-power increasing section based on a decision by the starting-lock discriminating section.

A compressor of one embodiment comprises an overcurrent protector for preventing any overcurrent of the motor, wherein when it is discriminated by the starting-lock discriminating section that the compressor body has locked, the starting-power increasing section repeats an operation including steps of boosting a voltage applied to the motor until the overcurrent protector is operated, and after the motor is stopped by operation of the overcurrent protector, boosting the voltage applied to the motor again to an operating voltage on which the overcurrent protector is operated, where the operation is repeated until the starting-lock discriminating section discriminates that the compressor body is not locked.

In one embodiment, when it is discriminated by the starting-lock discriminating section that the compressor body has locked, the starting-power increasing section repeats an operation of applying to the motor a preset boost voltage higher than a set voltage for normal start-up for a preset retention time, where the operation is repeated until the starting-lock discriminating section discriminates that the compressor body is not locked.

A compressor of one embodiment comprises an overcurrent protector for preventing any overcurrent of the motor, wherein when it is discriminated by the starting-lock discriminating section that the compressor body has locked, the starting-power increasing section performs a first operation of increasing a voltage applied to the motor to an operating voltage on which the overcurrent protector is operated, and thereafter a second operation of boosting the voltage applied to the motor again and, upon discrimination by the starting-lock discriminating section that the compressor body has locked, applying to the motor a preset boost voltage higher than a set voltage for normal start-up and lower than the operating voltage for a preset retention time, where the second operation is repeated until the starting-lock discriminating section discriminates that the compressor body is not locked.

In one embodiment, the starting-power increasing section increases the boost voltage as the operation is repeated.

A compressor of one embodiment comprises an overcurrent protector for preventing any overcurrent of the motor, wherein the starting-power increasing section repeats the operation until the overcurrent protector is operated.

In one embodiment, when it is discriminated by the starting-lock discriminating section that the compressor body has locked, the starting-power increasing section continues applying to the motor a preset boost voltage higher than a set voltage for normal start-up, the starting-lock discriminating section repeats a decision as to a lock of the piston in specified time intervals, and the starting-power increasing section continues application of the boost voltage until the starting-lock discriminating section discriminates that the compressor body is not locked.

A compressor of one embodiment comprises an overcurrent protector for preventing any overcurrent of the motor, wherein the starting-power increasing section increases a voltage applied to the motor, and upon a discrimination by the starting-lock discriminating section that the compressor body has locked, boosts the voltage applied to the motor up to an operating voltage on which the overcurrent protector is operated so that conduction of the motor is stopped, and thereafter again when it is discriminated by the starting-lock discriminating section that the compressor body has locked, the starting-power increasing section continues applying to the motor a preset boost voltage higher than a set voltage for normal start-up and lower than the operating voltage, the starting-lock discriminating section repeats a decision as to a lock of the piston in specified time intervals, and the starting-power increasing section continues application of the boost voltage until the starting-lock discriminating section discriminates that the compressor body is not locked.

A compressor of one embodiment comprises an overcurrent protector for preventing any overcurrent of the motor, wherein when it is discriminated by the starting-lock discriminating section that the compressor body has locked, the starting-power increasing section applies to the motor a preset boost voltage higher than a set voltage for normal start-up, and performs an operation of increasing the boost voltage stepwise each time the starting-lock discriminating section repeats the decision as to a lock of the compressor body in specified time intervals, where the operation is repeated until the starting-lock discriminating section discriminates that the compressor body is not locked, or until the overcurrent protector is operated so that the conduction of the motor is stopped.

In one embodiment, the icing-lock preventing section includes:

a starting-lock discriminating section for deciding whether or not the compressor body has locked at a start-up; and a heat-generation current control section for, when it is discriminated by the starting-lock discriminating section that the compressor body has locked, controlling a current to the motor to generate heat from the motor.

In this embodiment, when it is discriminated by the starting-lock discriminating section that the compressor body has locked, the heat-generation current control section controls the current to the motor to generate heat from the motor. Therefore, a lock of the piston due to iced matters can be prevented.

In one embodiment, the icing-lock preventing section further includes an operation-stopped state deciding section for deciding whether or not operation of the compressor body has been stopped in an elapse of a specified time after a stop of defrosting operation of an air conditioner, wherein when it is decided by the operation-stopped state deciding section that the compressor body has been stopped, the starting-lock discriminating section decides whether or not the compressor body has locked at a restart.

In this embodiment, the operation-stopped state deciding section decides whether or not operation of the compressor body has been stopped in an elapse of a specified time after a stop of defrosting operation of the air conditioner. That is, the operation-stopped state deciding section decides whether or not the condition for iced matters to grow and cause a lock is satisfied. Then, if the operation-stopped state deciding section decides that operation of the compressor body has been stopped, i.e. that the condition for iced matters to cause a lock is satisfied, the starting-lock discriminating section decides whether or not the compressor body has locked at a restart. Therefore, when the condition for iced matters to grow solid is satisfied, the current to the motor is controlled by the heat-generation current control section based on a decision by the starting-lock discriminating section.

In one embodiment, when it is discriminated by the starting-lock discriminating section that the compressor body has locked, the heat-generation current control section repeats an operation of applying to the motor a set voltage for normal start-up for a preset retention time until the starting-lock discriminating section discriminates that the compressor body is not locked.

In one embodiment, when it is discriminated by the starting-lock discriminating section that the compressor body has locked, the heat-generation current control section continues applying to the motor a set voltage for normal start-up, the starting-lock discriminating section repeats a decision as to a lock of the compressor body in specified time intervals, and the heat-generation current control section continues application of the set voltage until the starting-lock discriminating section discriminates that the compressor body is not locked.

In one embodiment, the icing-lock preventing section includes:

a heater for heating the compressor body;

a starting-lock discriminating section for deciding whether or not the compressor body has locked at a start-up; and a heat-generation current control section for, when it is discriminated by the starting-lock discriminating section that the compressor body has locked, controlling a current to the heater to generate heat from the heater.

In this embodiment, when it is discriminated by the starting-lock discriminating section that the compressor body has locked, the heat-generation current control section controls the current to the motor to generate heat from the motor. Therefore, a lock of the piston due to iced matters can be prevented In one embodiment, the icing-lock preventing section further includes an operation-stopped state deciding section for deciding whether or not operation of the compressor body has been stopped in an elapse of a specified time after a stop of defrosting operation of an air conditioner, wherein when it is decided by the operation-stopped state deciding section that operation of the compressor body has been stopped, the starting-lock discriminating section decides whether or not the compressor body has locked at a restart.

The compressor of the present invention, including the icing-lock preventing section, is enabled to prevent a lock of the piston due to iced matters after defrost operation.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the present invention will be described in detail by way of embodiments thereof illustrated in the accompanying drawings.

First Embodiment

Figure 1:
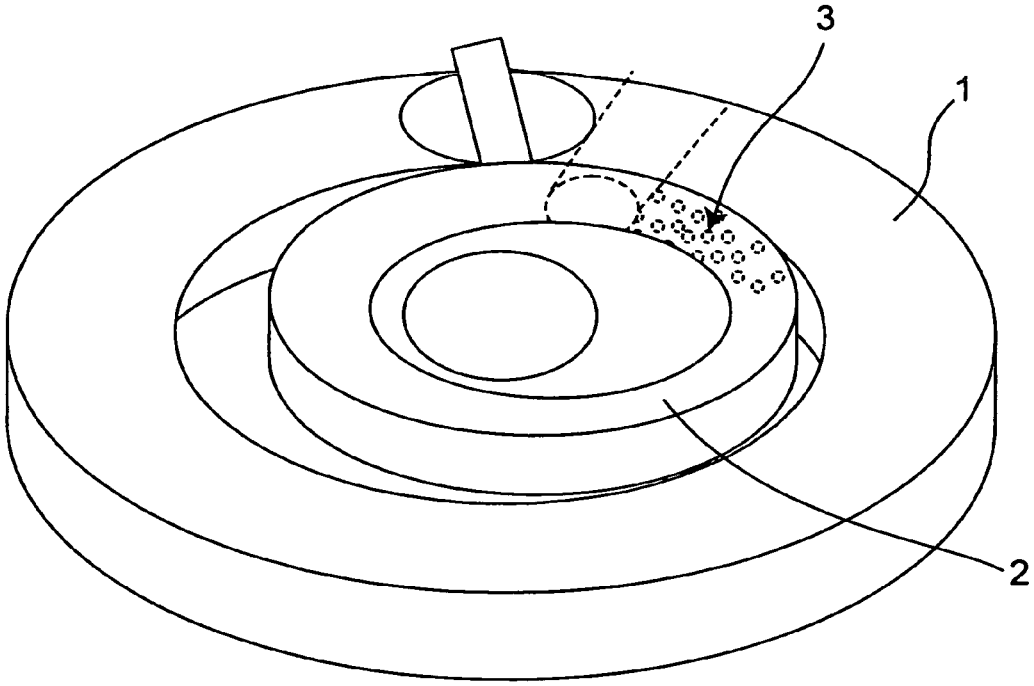
FIG. 1 is a perspective view for explaining a state in which iced matters are generated.
Figure 2A:
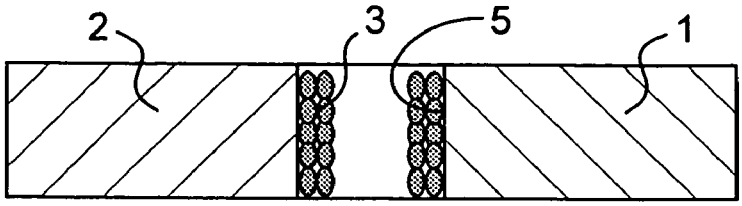
FIG. 2A is a sectional view for explaining a process in which frost or ice is grown to be increased in density and solidified.
Figure 2B:
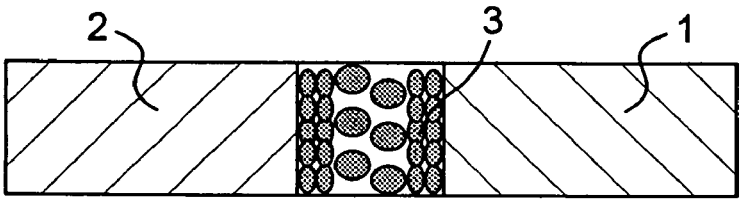
FIG. 2B is a sectional view for explaining a process in which frost or ice is grown to be increased in density and solidified.
Figure 2C:
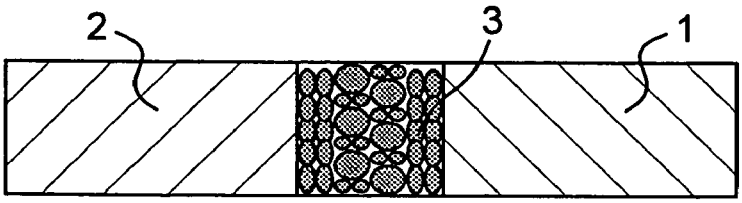
FIG. 2C is a sectional view for explaining a process in which frost or ice is grown to be increased in density and solidified.
Figure 2D:
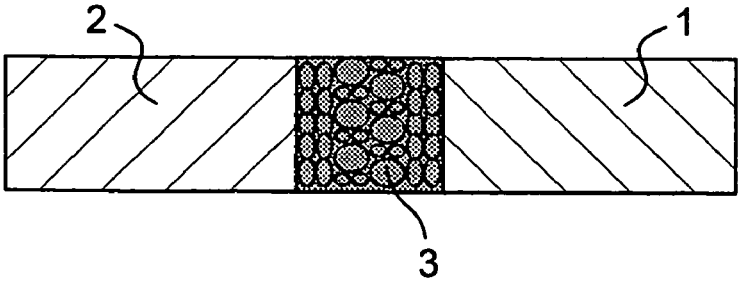
FIG. 2D is a sectional view for explaining a process in which frost or ice is grown to be increased in density and solidified.
Figure 3:
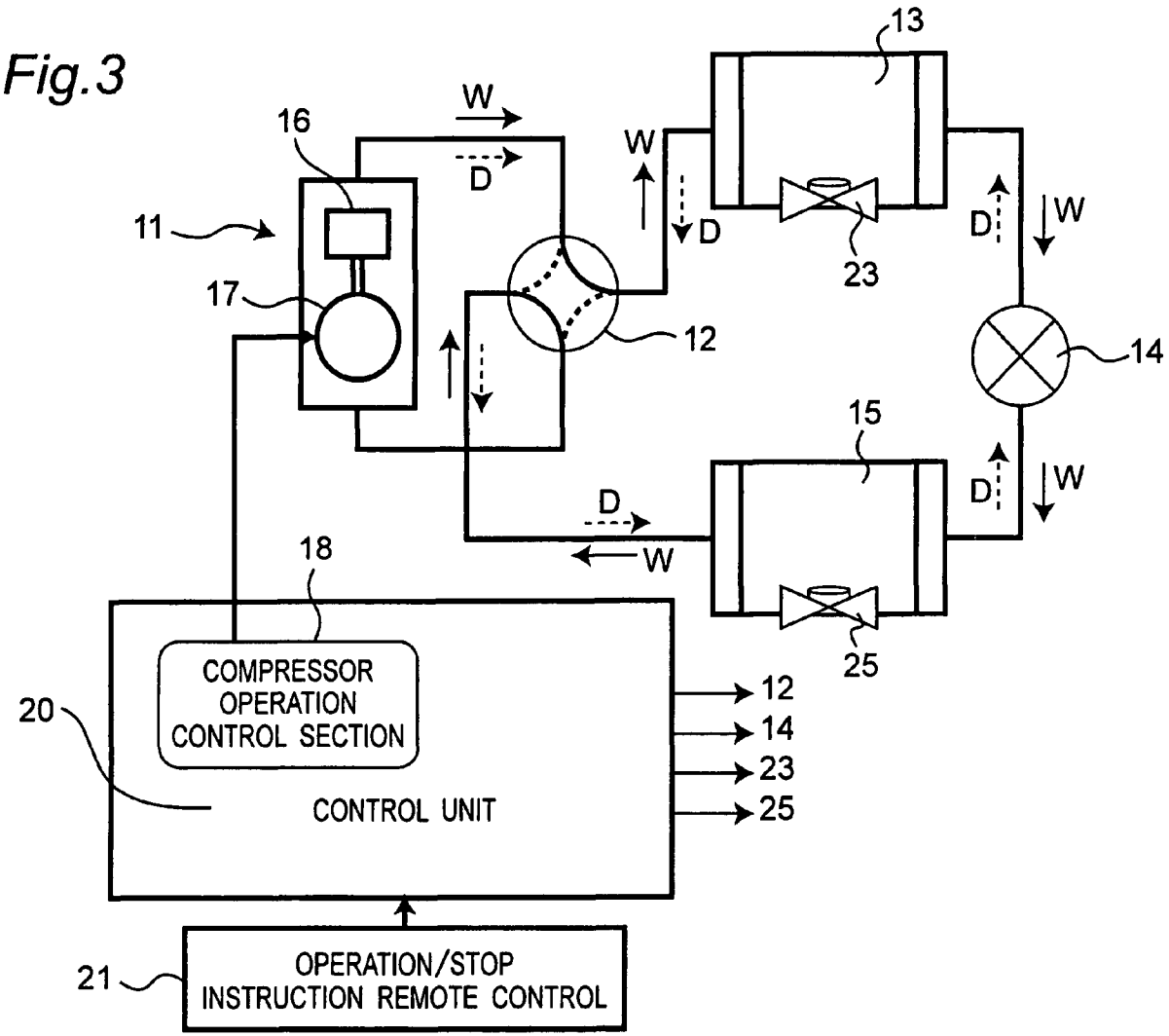
FIG. 3 is a block diagram of a compressor and an air conditioner according to a first embodiment.
Figure 4:
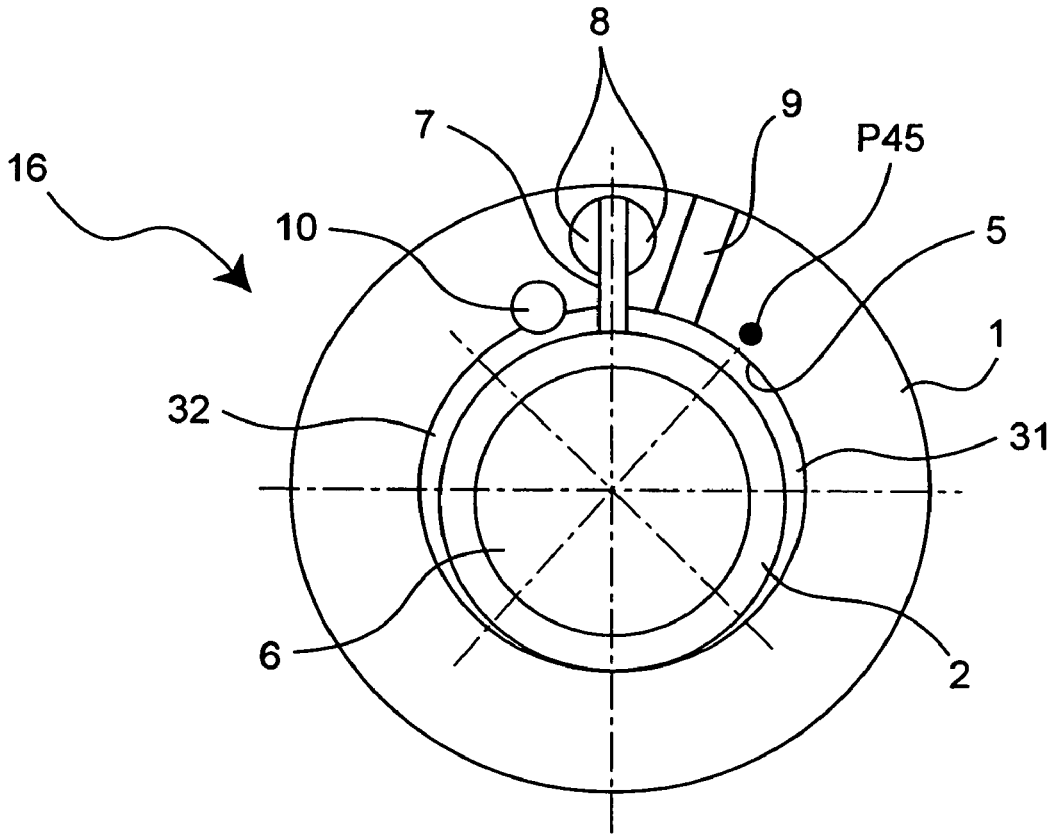
FIG. 4 is a sectional view of the compressor of the first embodiment.

FIG. 3 is a block diagram of an air conditioner according to a first embodiment, and FIG. 4 is a schematic view of a compression section of the compressor.

As shown in FIG. 3, the air conditioner has a refrigerant circuit formed by connecting, one after another in a loop, a compressor 11, a four-way switching valve 12, an indoor heat exchanger 13, an expansion valve 14 as an example of an expansion section, an outdoor heat exchanger 15, the four-way switching valve 12 and the compressor 11.

During heating operation, a flow passage of the four-way switching valve 12 is as shown by solid line, where the refrigerant flows along a direction indicated by arrow W. Meanwhile, during defrost operation, the four-way switching valve 12 is switched to a state of the flow passage indicated by broken line, where the refrigerant flows as shown by arrow D so that a reversed-cycle defrost is performed.

The air conditioner also includes a control unit 20 for controlling the compressor 11, the four-way switching valve 12, an indoor fan 23 for the indoor heat exchanger 13, the expansion valve 14 and an outdoor fan 25 for the outdoor heat exchanger 15. The control unit 20 has a compressor operation control section 18, and receives a signal of instruction for operation or stop of the air conditioner from a remote control 21.

Also, the compressor 11 is a swing type compressor. The compressor 11 includes a compressor body 16, and a motor 17 for driving the compressor body 16. The compressor body 16, as shown in FIG. 4, includes a cylinder 1 by which a cylinder chamber 5 is defined, a cylindrical-shaped piston 2 rotatably fitted to an eccentric portion 6 of a drive shaft, a blade 7 integrally fixed to the piston 2, two semicolumnar-shaped bushings 8, 8 by which the blade 7 is slidably sandwiched on both sides, a suction port 9, and a discharge port 10. The integrally formed piston 2 and blade 7 divide interior of the cylinder chamber 5 into a suction chamber 31 and a compression chamber 32. By revolutionary motion of the piston 2, i.e., swing motion of the integrated blade 7 and piston 2, the refrigerant gas is sucked into the suction chamber 31 through the suction port 9, and compressed in the compression chamber 32 and discharged through the discharge port 10.

Figure 5:
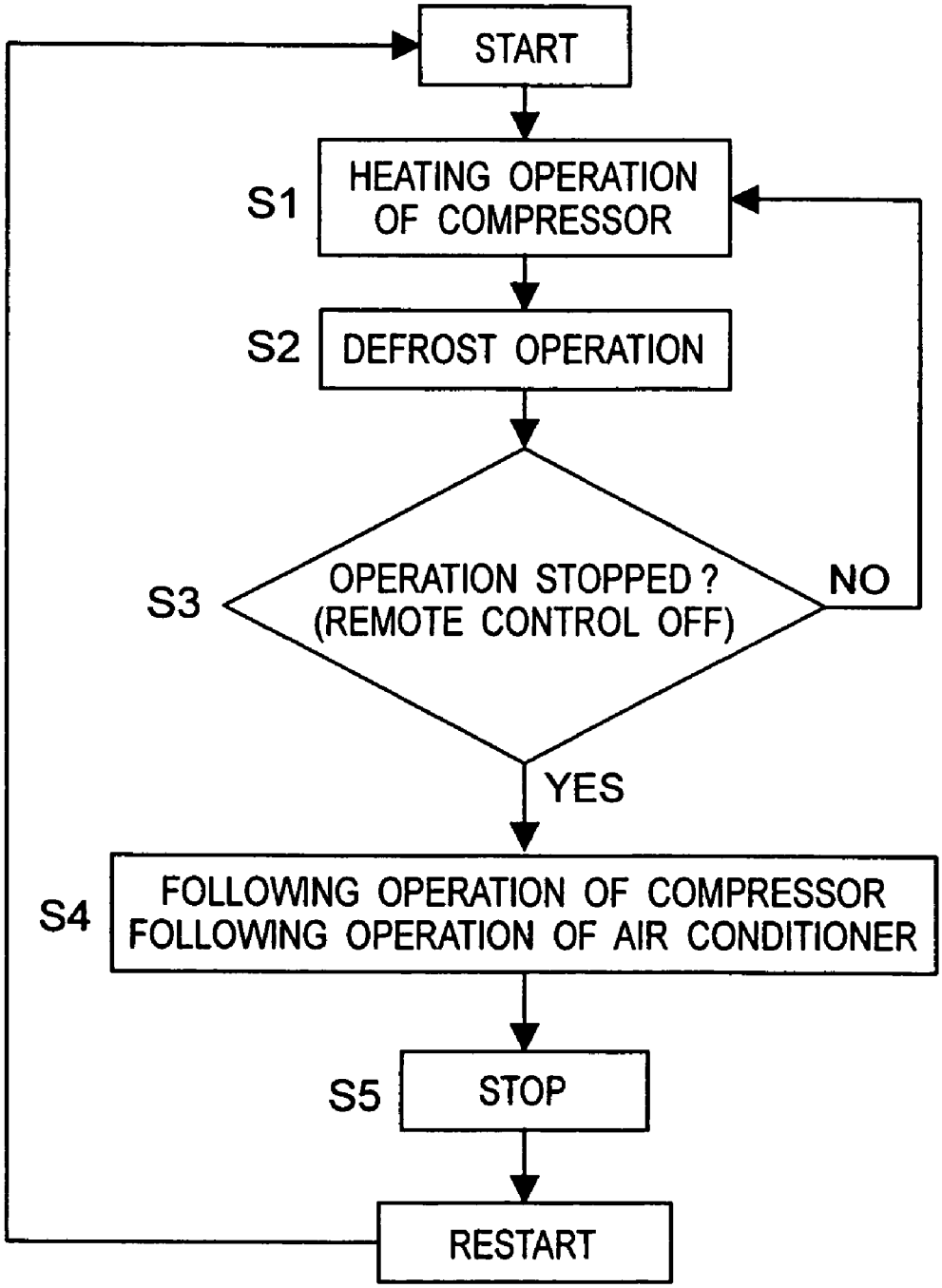
FIG. 5 is a flowchart representing control on the compressor of the first embodiment.

The control unit 20 contains an unshown microcomputer, and has a crystal growth inhibiting section as an example of the icing lock preventing section. The crystal growth inhibiting section is implemented by such software as shown in FIG. 5. It is noted that the crystal growth inhibiting section is part of the compressor operation control section 18 and may be regard as part of the compressor 11.

As shown in FIG. 5, the compressor 11 performs heating operation (step S1), and thereafter performs defrost operation (step S2).

Next, it is decided whether or not an operation stop instruction has been outputted from the remote control 21. If it is decided that an operation stop instruction has been outputted, then operation of the motor 17 is stopped. On the other hand, if it is decided that no operation stop instruction has been outputted from the remote control 21, then the compressor returns to heating operation (step S3, step S1).

Further, in the step S3, as a second decision, it is also decided whether or not the operation of the compressor body 16 has been stopped, in an elapse of specified time, e.g. 5 minutes, after an end of the defrost operation. However, several minutes not more than 60 minutes may be selected as the specified time according to specifications and conditions of the air conditioner. Whether or not the operation has been stopped is decided depending on whether or not a stop signal had already been transmitted from the remote control 21 to the control unit 20 by the time five minutes before. This step S3 is an example of an operation-stopped state deciding section for deciding whether or not the compressor has been in an operation stopped state for a specified time since a stop of the compressor under defrost operation or since an operation stop of the compressor immediately after a return from defrost operation to heating operation (the state is a condition under which solid iced matters are easily generated). In this case, by the motor 17 not conducting, it may also be decided that the compressor has been actually stopped from operation. Or, by an unshown rotation sensor not outputting a signal representing a change in rotational position of the motor 17 or the compressor body 16, it may also be decided that the compressor body 16 has been actually stopped from operation.

If the operation-stopped state deciding section has decided that the compressor body 16 had stopped in an elapse of a specified time, e.g. 5 minutes, after an end of defrost operation, then the compressor operation control section 18 exerts control to feed a drive current to the motor 17 so that the compressor body 16 of the compressor 11 is forcedly operated for a specified time (step S3, step S4). That is, following operation of the compressor is performed. The step S4 is an example of a following-operation-of-compressor control section. While the compressor operation control section 18 is performing the following operation of the compressor, the control unit 20 controls the four-way switching valve 12 so that the four-way switching valve 12 is switched to the heating operation side and moreover controls the outdoor fan 25 for the outdoor heat exchanger 15 and the indoor fan 23 for the indoor heat exchanger 13 so that they are stopped (step S4). In this way, the user is kept from being aware of the following operation. The step S4 is an example of a following-operation-of-air-conditioner control section. It is noted that at this time point, the expansion valve 14 has already been in a largely opened state for pressure equalization. In addition, it is also possible to stop only the indoor fan 23 of the indoor heat exchanger 13 without stopping the outdoor fan 25 of the outdoor heat exchanger 15. In this case also, the user can be kept from being aware of the follow operation.

Next, the following operation of the compressor and the following operation of the air conditioner is continued for several minutes, and thereafter the following operation of the compressor and the following operation of the air conditioner are stopped (step S5). By the following operation of the compressor and the following operation of the air conditioner, frost and ice (iced matters) in the cylinder 1 are inhibited from crystal growth.

Thus, it has been found that when the compressor is operated for following operation of the compressor and the following operation of the air-conditioner, thereafter stopped and then restarted, there does not occur a lock of the compressor 11, i.e. locking of the piston 2 to the cylinder 1 by iced matters.

Figure 6:
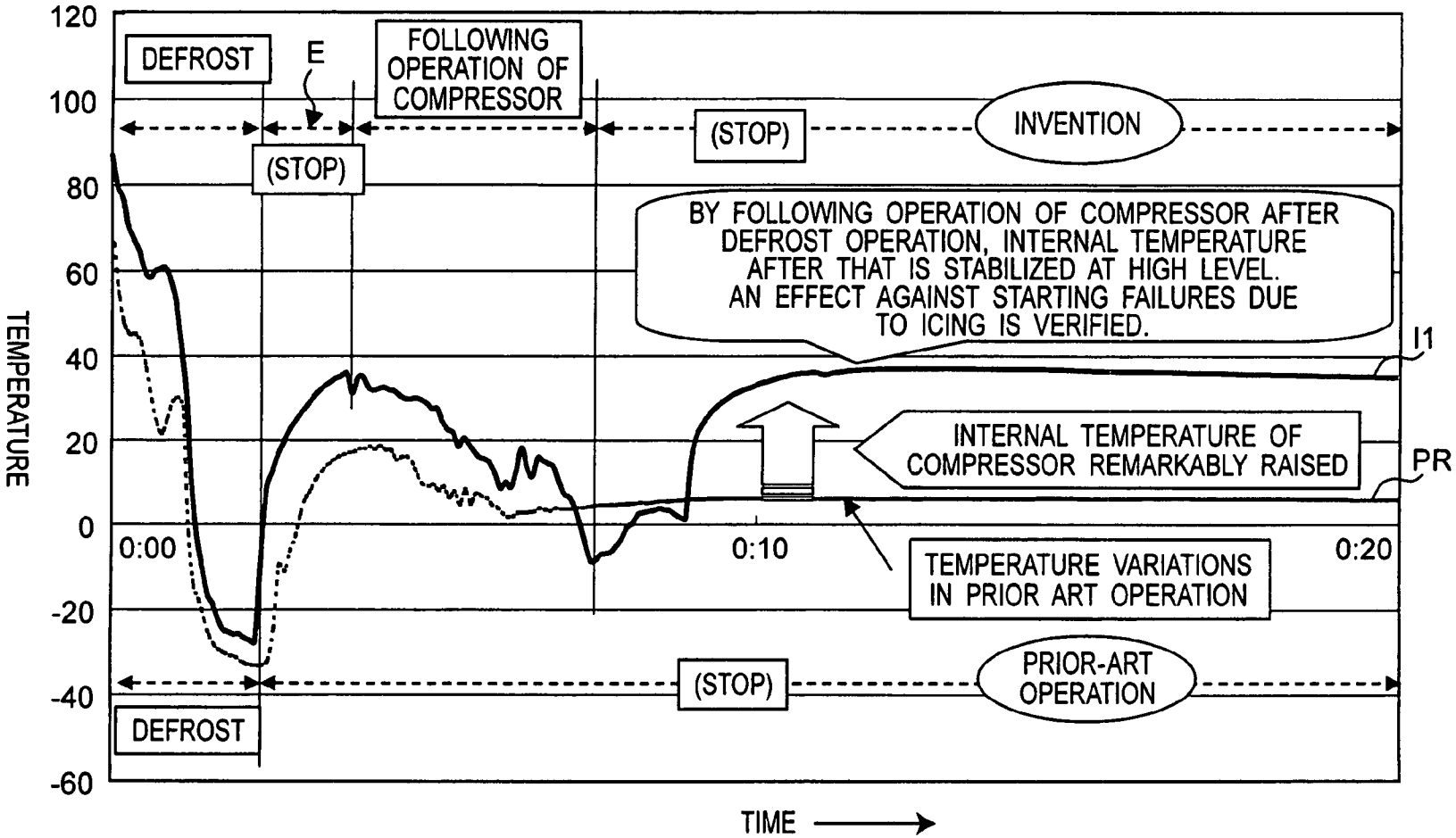
FIG. 6 is a graph representing measured values of temperature variations inside the compressor.

FIG. 6 shows internal temperatures of compressors with respect to the compressor according to the first embodiment in which following operation of the compressor and following operation of the air conditioner are performed, and a compressor according to the prior art in which neither the following operation of the compressor nor the following operation of the air conditioner is performed. More specifically, FIG. 6 shows temperatures at a site P45 of the cylinder 1 having a phase angle of 45° from the blade 7 toward a revolutionary direction of the piston 2 about the center of the cylinder chamber 5 as viewed in FIG. 4. In FIG. 6, a horizontal axis shows time, a vertical axis shows temperature (° C.), a curve I1 represents variations in internal temperature of the compressor of the first embodiment, and a curve PR represents variations in internal temperature of the compressor of the prior art. From these curves I1, PR, it can be understood that the compressor of the first embodiment show no occurrence of starting failures due to icing by virtue of larger increases in internal temperature, as compared with the compressor of the prior art. In FIG. 6, in a section indicated by arrow E immediately after defrost operation, the expansion valve 14 is opened to make the refrigerant circuit equalized in pressure between high pressure and low pressure sides.

Also according to the first embodiment, the operation-stopped state deciding section (step S3) decides whether or not the operation of the compressor body 16 has been stopped in an elapse of a specified time after an end of the defrost operation of the air conditioner. That is, the operation-stopped state deciding section decides whether or not the condition for iced matters to grow enough to cause a lock is satisfied. Then, if the operation-stopped state deciding section (step S3) has decided that the operation of the compressor body 16 has been stopped, i.e. that the condition for occurrence of a lock by iced matters is satisfied, the following-operation-of-compressor control section (step S4) controls the motor 17 to make the compressor body 16 forcedly operated for a specified time. Accordingly, the compressor 11 can be operated with growth of iced matters inhibited when the condition for iced matters to grow solid is satisfied, and the compressor 11 can be kept out of operation when the condition for iced matters to grow solid is not satisfied.

In a swing type compressor, in which the piston and the blade are fixed integrally, since the piston performs swing motion so that one side of the piston is always maintained confronting the low temperature side of the cylinder on which the suction port is provided, it is more likely that the piston may be locked to the cylinder by iced matters. However, in the first embodiment, since the crystal growth inhibiting section, i.e. the operation-stopped state deciding section, the following-operation-of-compressor control section and the following-operation-of-air-conditioner control section are included, even the swing type compressor is enabled to prevent locks due to iced matters with reliability.

Further, in a rotary type compressor in which the piston and the blade are independent of each other, the piston being to rotate and revolve, it is also possible to provide the crystal growth inhibiting section, i.e. the operation-stopped state deciding section, the following-operation-of-compressor control section and the following-operation-of-air-conditioner control section so that the rotary type compressor can be prevented from locking due to iced matters.

Second Embodiment

Figure 7:
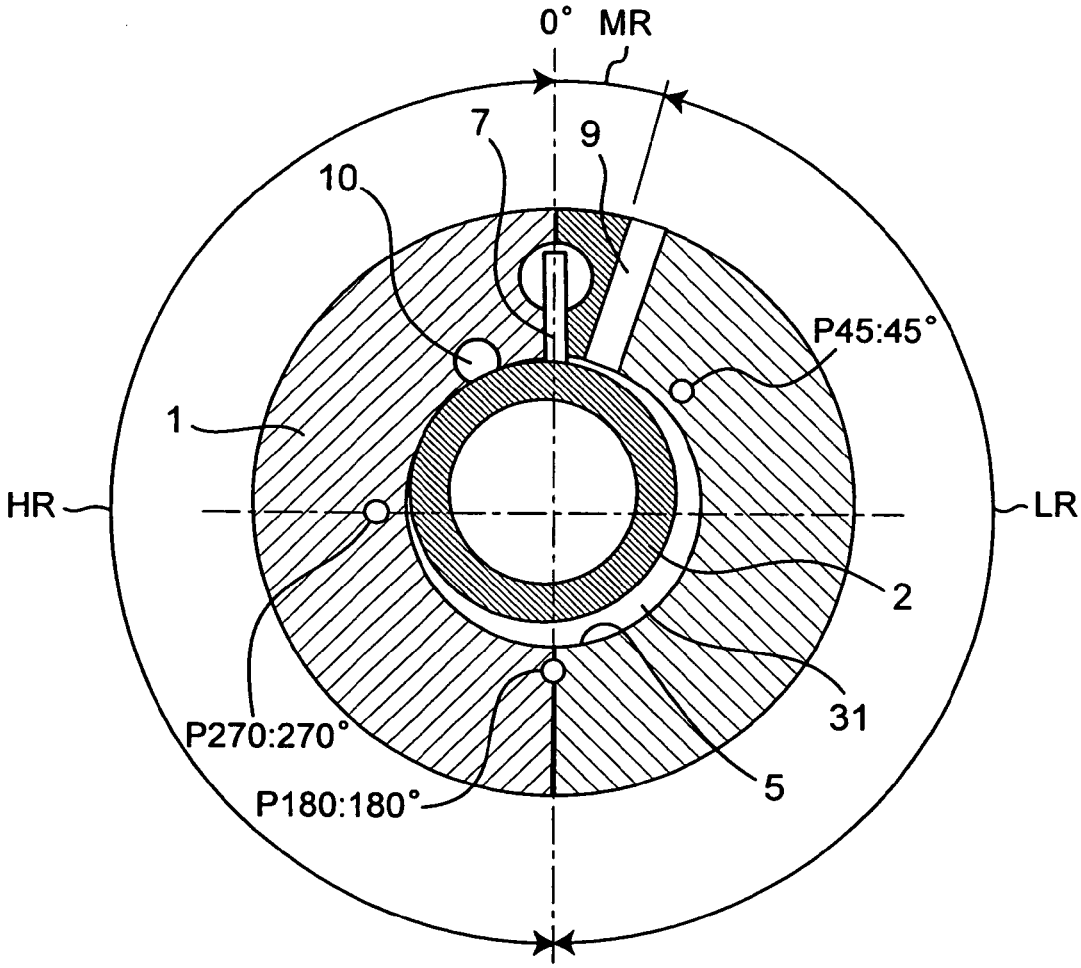
FIG. 7 is a sectional view representing a temperature distribution of a compressor according to a second embodiment.
Figure 8:
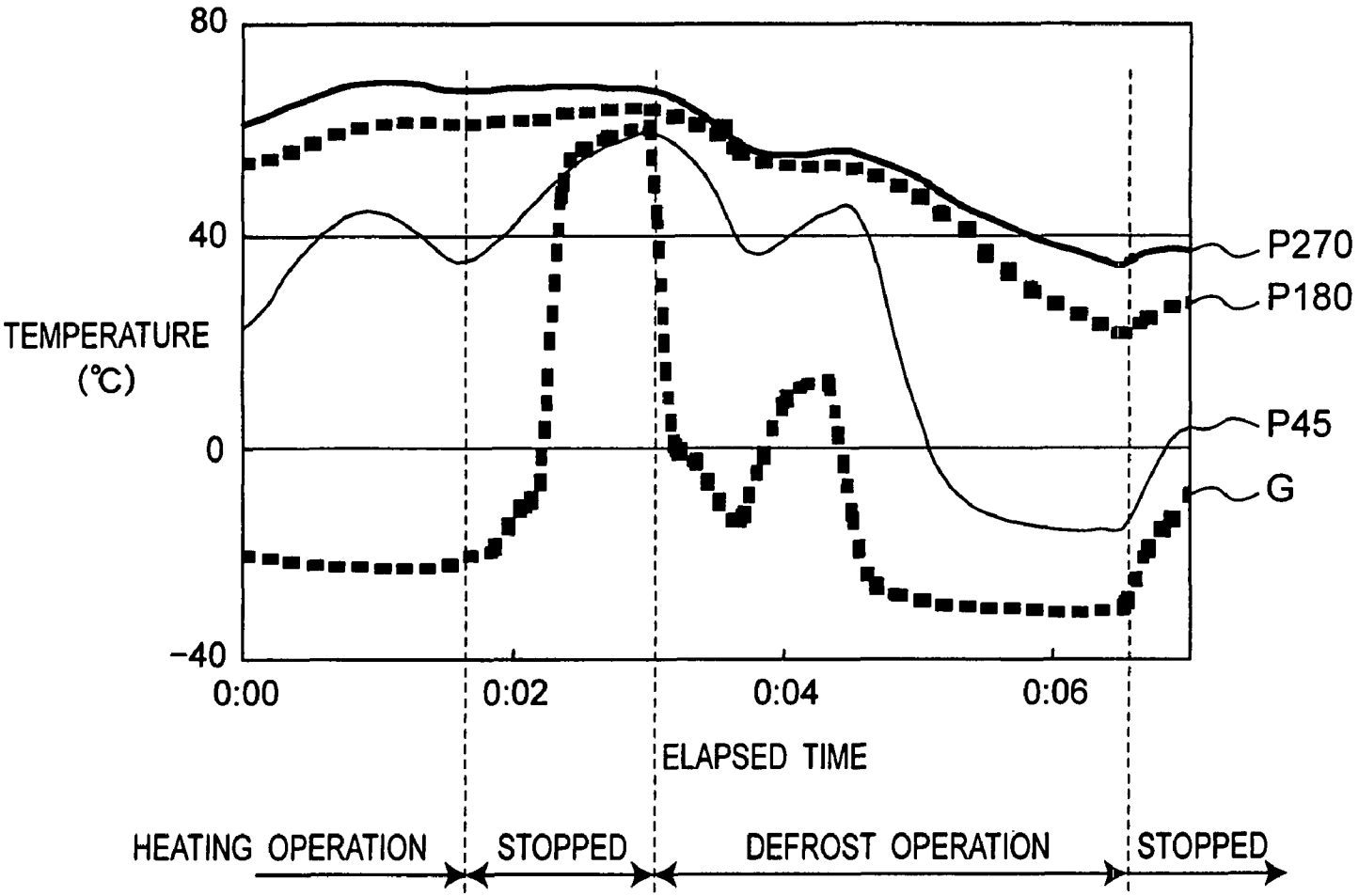
FIG. 8 is a graph representing measured values of temperature variations at various sites of the compressor.

FIGS. 7 and 8 are views for explaining temperature distributions of a compressor body.

In FIG. 7, a cylinder 1, a piston 2, a blade 7, a suction port 9 and a discharge port 10 are identical in construction to those of the first embodiment shown in FIG. 4, and therefore designated by the same reference numerals as those, their detailed description being omitted.

Referring to FIG. 7, P45 represents a site of the cylinder 1 having a phase angle of 45° from the blade 7 toward the revolutionary direction of the piston 2 about the center of the cylinder chamber 5, P180 represents a site having a phase angle of 180° from the blade 7 toward the revolutionary direction of the piston 2 about the center of the cylinder chamber 5, and P270 represents a site having a phase angle of 270° from the blade 7 toward the revolutionary direction of the piston 2 about the center of the cylinder chamber 5.

On the other hand, FIG. 8 represents measured temperatures (° C.) of the sites P45, P180 and P270 of the compressor under the same conditions under which the compressor had a starting failure as well as temperatures of a refrigerant gas G sucked through the suction port 9. Referring to FIG. 8, curves P45, P180 and P270 represent variations of measured temperatures (° C.) of the sites P45, P180 and P270 corresponding to time elapses (where heating operation, stop, defrost operation and stop are performed in order), and the curve G represents variations of temperatures (° C.) of the refrigerant gas G sucked through the suction port 9 corresponding to time elapses.

As can be understood from FIG. 8, at a time point when a defrost operation is terminated and a time point when the compressor is stopped after that time point, temperatures of the sites P180 and P270 are higher than that of the site P45. This is because, in FIG. 7, the refrigerant gas in the suction chamber 31 communicated with the suction port 9 is low in temperature, while the refrigerant gas in the compression chamber 32 (see FIG. 4) communicated with the discharge port 10 is high in temperature due to adiabatic compression.

Referring to FIG. 7, a low-temperature region LR where frost or ice of the inner circumferential surface of the cylinder 1 is more easily generated refers to a region of the inner circumferential surface of the cylinder 1 between the suction port 9 and the site of 180° from the blade 7 toward the moving direction of the piston 2 about the center of the cylinder chamber 5. On the other hand, high-temperature regions HR and MHR refer to regions where frost or ice of the inner circumferential surface of the cylinder 1 is less easily generated, being regions other than the low-temperature region LR. The high-temperature region HR of the inner circumferential surface of the cylinder 1 ranging from 180° to 360° from the blade 7 toward the moving direction of the piston 2 about the center of the cylinder chamber 5 is a high-temperature region HR of comparatively higher temperatures, while a region of the inner circumferential surface of the cylinder 1 between the blade 7 and the suction port 9 is a high-temperature region MR of comparatively lower temperatures (intermediate high temperatures).

In the compressor of this second embodiment, the piston 2 is stopped by a later-described piston-stop-position control section in the high-temperature region HR of comparatively higher temperatures, where frost or ice of the inner circumferential surface of the cylinder 1 is less easily generated. Thus, the generation of iced matters between the high-temperature region HR of the inner circumferential surface of the cylinder 1 and the piston 2 is prevented, so that the lock of the piston 2 due to iced matters is prevented.

Figure 9:
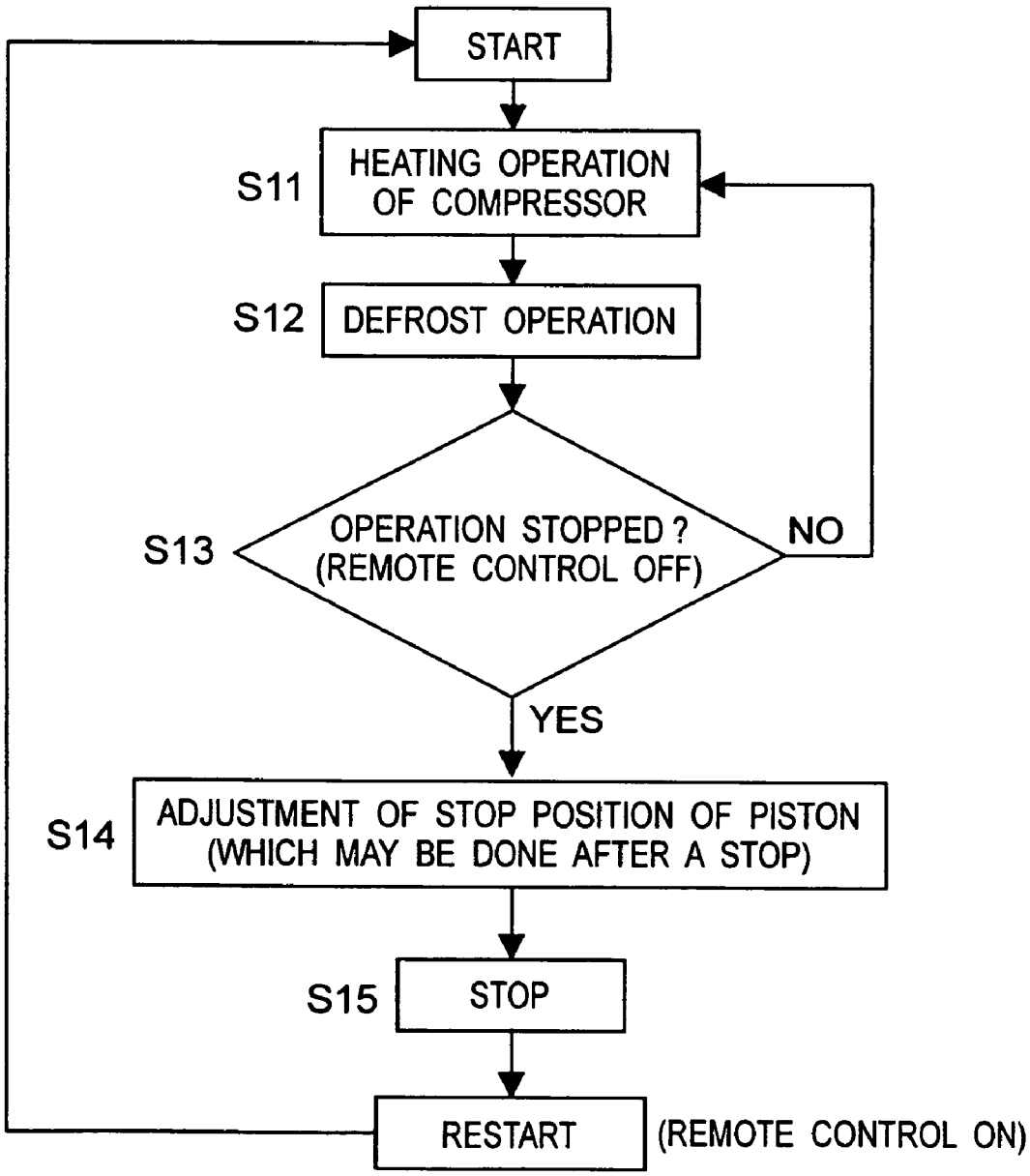
FIG. 9 is a flowchart representing control on the compressor of the second embodiment.

The piston-stop-position control section is implemented by such software as shown in FIG. 9. A block diagram of the compressor of this second embodiment is similar to FIG. 3, and so FIG. 3 is used in common. The piston-stop-position control section is part of the compressor operation control section 18 shown in FIG. 3.

As shown in FIG. 9, the compressor 11 performs heating operation (step S11), and thereafter performs defrost operation (step S12).

Next, it is decided whether or not an operation stop for the compressor body 16 has been instructed during defrost operation of the air conditioner (step S13). This decision as to whether or not the operation has been stopped is decided depending on whether or not a stop signal has been transmitted from the remote control 21 to the control unit 20. This step S13 forms a stop instruction deciding section.

If it is decided that an operation stop instruction has not been outputted from the remote control 21, then the compressor is returned to heating operation (step S13, step S11).

If it is decided by the stop instruction deciding section that an operation stop instruction has been outputted from the remote control 21, then the piston 2 of the compressor body 16 is stopped in the high-temperature region HR of comparatively higher temperatures, where frost or ice of the inner circumferential surface of the cylinder 1 is less easily generated (step S14, step S15). Even with the piston 2 once stopped, if the stop position of the piston 2 is in the low-temperature region LR, the piston 2 is moved to the high-temperature region HR. The step S14 and step S15 form an example of the piston-stop-position control section.

In this way, the generation of iced matters between the high-temperature region HR of the inner circumferential surface of the cylinder 1 and the piston 2 can be prevented, so that occurrence of starting failures can be prevented by preventing the piston 2 from locks due to iced matters.

A concrete method for stopping the piston 2 in the high-temperature region HR is, for example, to detect a rotational angle of the drive shaft of the piston 2 or the motor 17 by a sensor and control the stop position of the piston 2 by feedback so that the rotational angle detected by the sensor becomes a target rotational angle corresponding to the high-temperature region HR.

In the second embodiment, the piston-stop-position control section is operated when it is decided by the stop instruction deciding section that a stop instruction has been outputted during defrost operation. However, as a modification, the piston-stop-position control section may also be operated when a stop instruction had been outputted immediately (e.g., within 3 minutes) after a return to heating operation after an end of defrost operation. In this case, the lock of the piston 2 due to iced matters can be prevented with higher reliability.

Also, in the second embodiment, the piston 2 is stopped in the high-temperature region HR of comparatively higher temperatures, where frost or ice of the inner circumferential surface of the cylinder 1 is less easily generated. However, as another modification, the piston 2 may also be stopped in the high-temperature region HR of comparatively higher temperatures and the high-temperature region MR of comparatively lower temperatures (intermediate temperatures) other than the low-temperature region LR where frost or ice of the inner circumferential surface of the cylinder 1 is more easily generated. In this case, iced matters are even less generated between the intermediately high-temperature region MR of the inner circumferential surface of the cylinder 1 and the piston 2, than in the low-temperature region LR, and further the region where the piston can be stopped is widened, facilitating the control for the stop position.

In still another modification, if a stop instruction has been outputted during the operation of the compressor, i.e. regardless of defrost operation and heating operation, the piston-stop-position control section is unconditionally operated. Then, locks due to iced matters can be prevented, facilitating the control.

Figure 10:
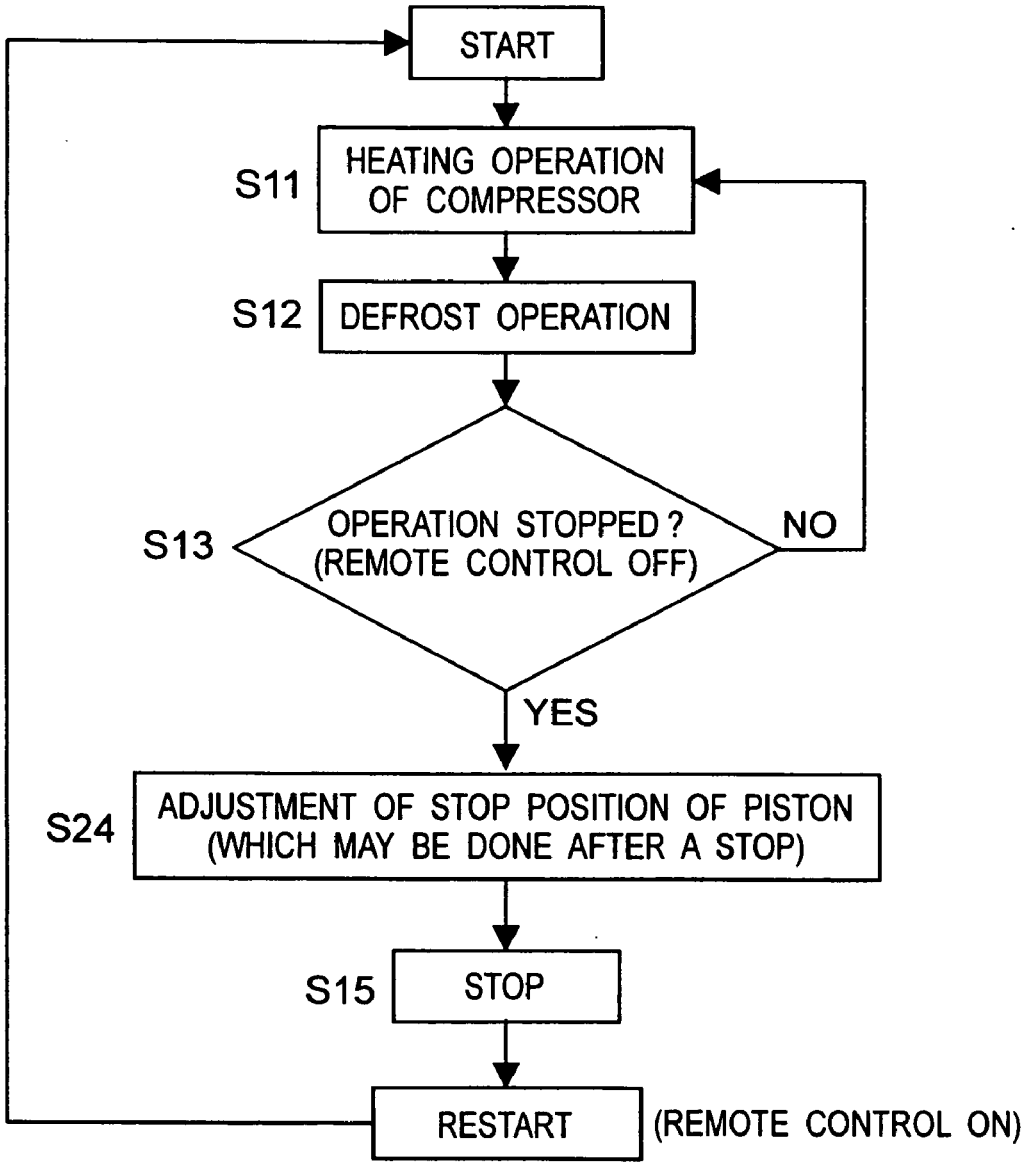
FIG. 10 is a flowchart representing control in a modification of the second embodiment.

FIG. 10 shows a flowchart of another modification. In FIG. 10, steps S11, S12 and S13 are the same as the steps S11, S12 and S13 shown in FIG. 9, and therefore their description is omitted.

At step S13, if it is decided that an operation stop instruction has been outputted, the piston 2 is stopped in the high-temperature region HR, MR so that the clearance between the inner circumferential surface of the cylinder 1 and the piston 2 becomes not less than 500 μm in the low-temperature region LR (step S24, S15). These steps S24, S15 form an example of the piston-stop-position control section.

Thus, since a clearance of 500 μm or more is ensured between the inner circumferential surface of the cylinder 1 and the piston 2 in the low-temperature region LR, which is of low temperature so that frost or ice is more easily deposited, occurrence of starting failures can be prevented.

In this modification also, the piston-stop-position control section may be operated also when a stop instruction has been outputted immediately (e.g., within 3 minutes) after a return to heating operation after an end of defrost operation.

Third Embodiment

A compressor of this third embodiment is so designed that with a decision of a compressor lock upon occurrence of a starting failure during heating operation, supply power to a compressor for start-up is increased so that starting torque of a motor is increased to make the starting power increased, by which the starting performance is improved.

Figure 11:
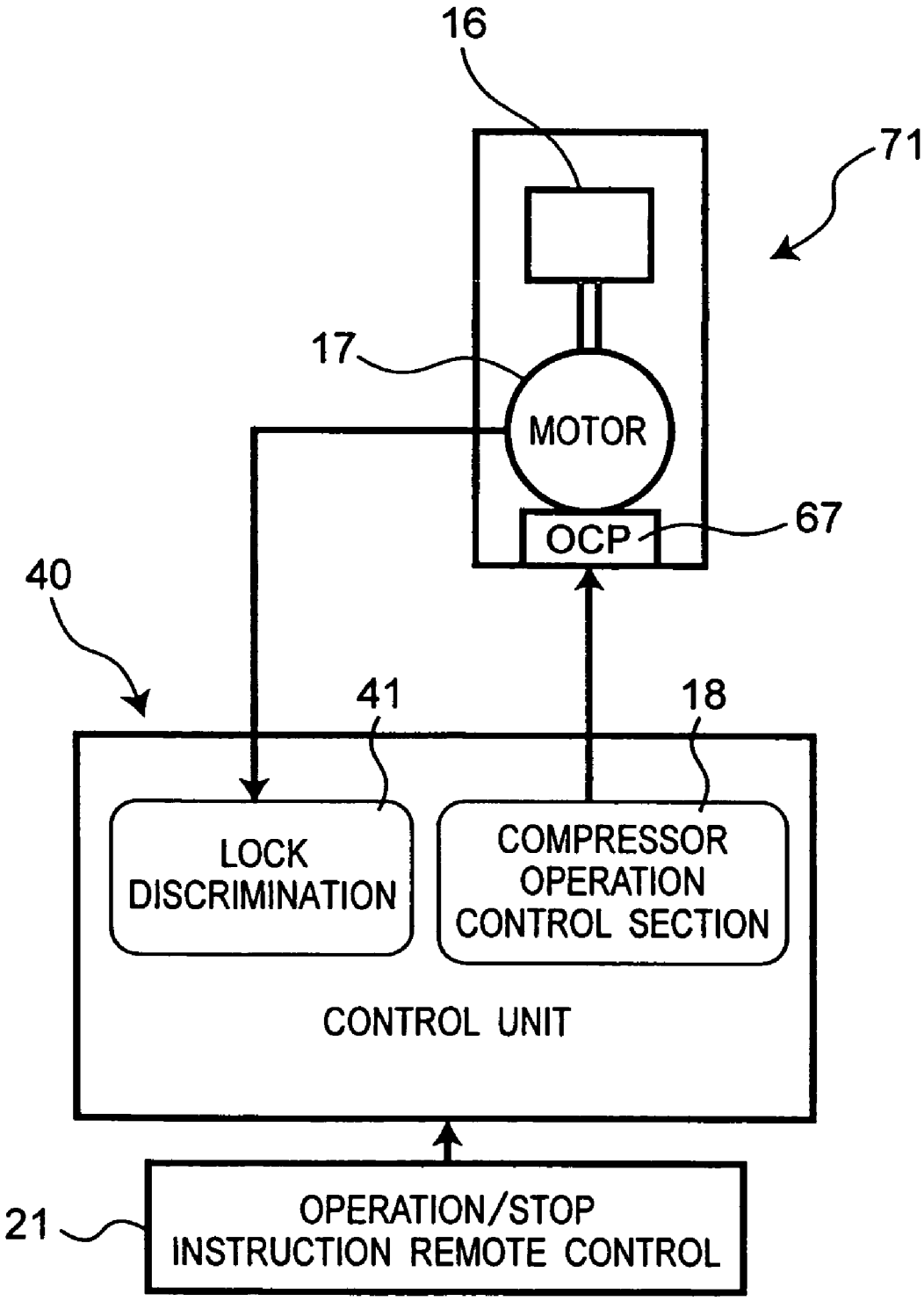
FIG. 11 is a block diagram of a compressor according to a third embodiment.

FIG. 11 is a block diagram of a compressor 71 according to the third embodiment. Component parts identical to those of the compressor 11 of the first embodiment shown in FIG. 3 are designated by like reference numerals, and their detailed description is omitted.

As shown in FIG. 11, the compressor 71 includes an OCP (Over Current Protector) 67 for preventing an overcurrent to the motor 17, and a control unit 40. The control unit 40, which forms an example of an icing lock preventing section, has a compressor operation control section 18 and a starting-lock discriminating section 41. The icing-lock preventing section is implemented by software shown in FIG. 12, including an operation-stopped state deciding section, a starting-lock discriminating section and a starting-power increasing section.

Figure 12:
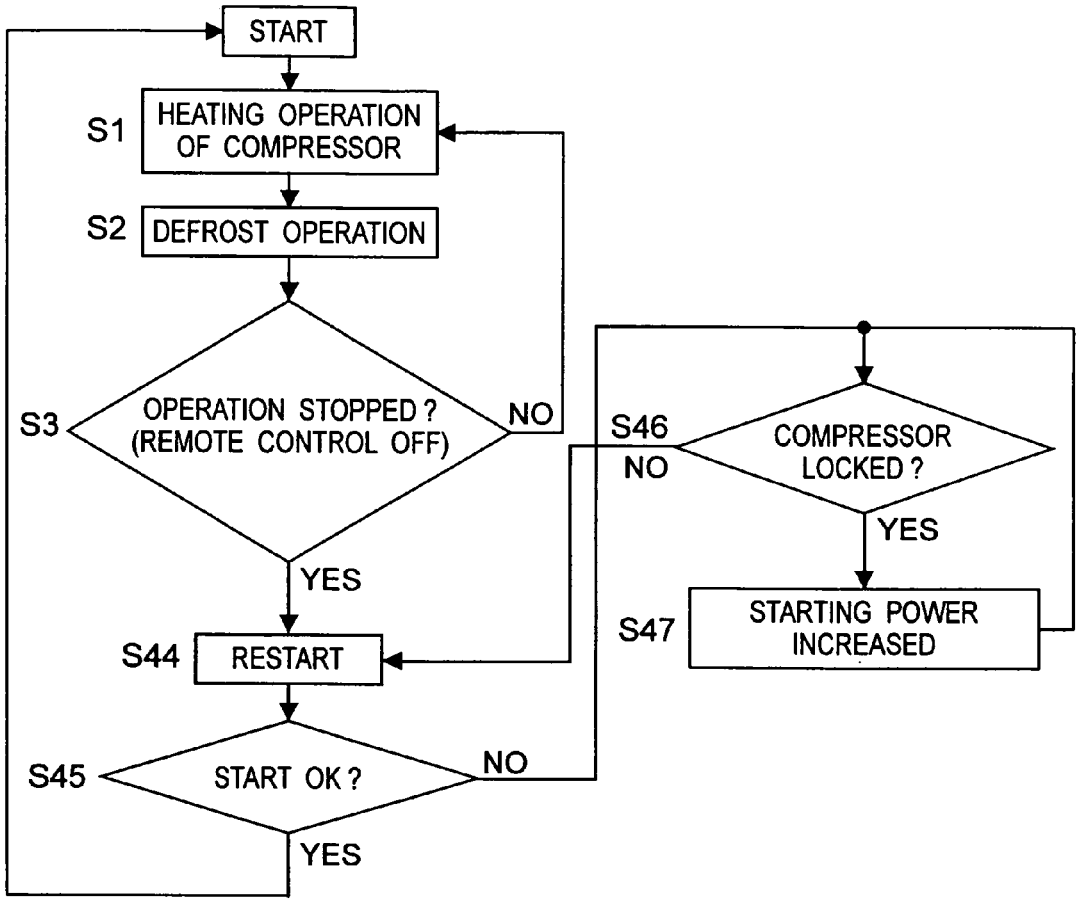
FIG. 12 is a flowchart representing control on the compressor of the third embodiment.

As shown in FIG. 12, the compressor 71 performs heating operation (step S1), and thereafter performs defrost operation (step S2).

Next, it is decided whether or not an operation stop instruction has been outputted from the remote control 21. If it is decided that an operation stop instruction has been outputted, then operation of the motor 17 is stopped. On the other hand, if it is decided that no operation stop instruction has been outputted from the remote control 21, then the compressor returns to heating operation (step S3, step S1)

Further, in the step S3, as a second decision, it is also decided whether or not the operation of the compressor body 16 has been stopped, in an elapse of specified time, e.g. 5 minutes, after an end of the defrost operation (step S3). However, several minutes not more than 60 minutes may be selected as the specified time according to specifications and conditions of the air conditioner. Whether or not the operation has been stopped is decided depending on whether or not a stop signal had already been transmitted from the remote control 21 to the control unit 40 by the time five minutes before. This step S3 is an example of an operation-stopped state deciding section for deciding whether or not the compressor has been in an operation stopped state for a specified time since a stop of the compressor under defrost operation or since an operation stop of the compressor immediately after a return from defrost operation to heating operation (the state is a condition under which solid iced matters are easily generated). In this case, by the motor 17 not conducting, it may also be decided that the compressor has been actually stopped from operation. Or, by an unshown rotation sensor not outputting a signal representing a change in rotational position of the motor 17 or the compressor body 16, it may also be decided that the compressor body 16 has been actually stopped from operation.

Subsequent to step S3, it is assumed that a restart instruction for the compressor 71 is issued (step S44).

Then, it is decided whether or not the compressor body 16 has been actually started (step S45). The decision as to the start can be made, for example, by detecting a change in refrigerant pressure of the refrigerant circuit with an unshown pressure sensor.

If it is decided at step S45 that the compressor body 16 has been started up, then the control flow returns to the start. On the other hand, if it is decided that the compressor body 16 has not been started up, then the control flow goes to step S46.

Figure 13:
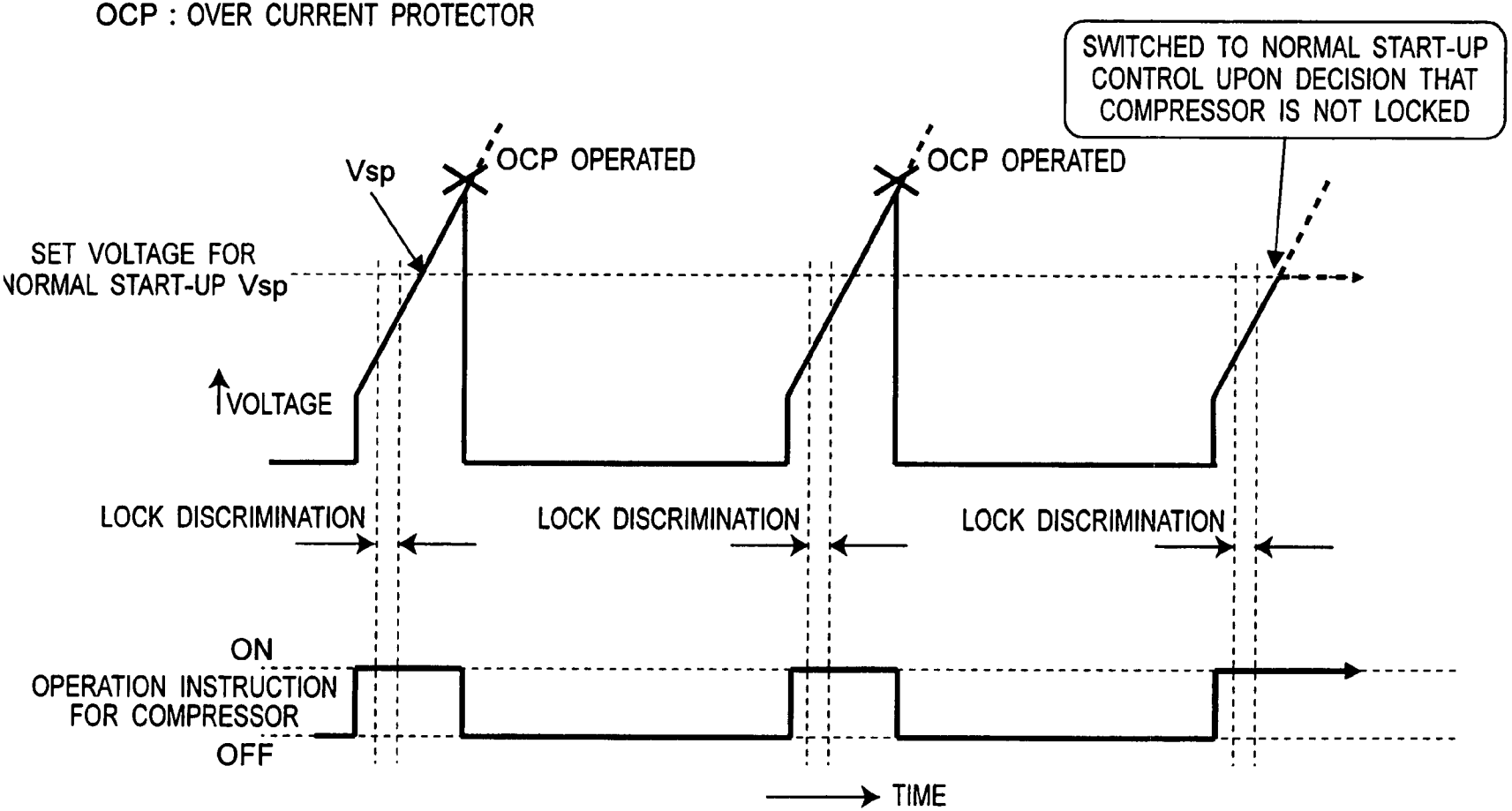
FIG. 13 is a view for explaining operation of a starting-power increasing section.

At step S46, as shown in FIG. 13, it is discriminated whether or not the compressor body 16 has locked in a voltage-increasing process to a set voltage Vsp provided for a normal starting of the compressor 71. If it is discriminated that the compressor body 16 has not locked, the control flow goes to step S44. If it is discriminated that the compressor body 16 has locked, the control flow goes to step S47. The discrimination as to the lock of the compressor body 16 is made depending on whether or not, with the motor 17 conducting, a signal representing that the motor 17 or the compressor body 16 is rotating can be detected. More specifically, this is done, for example, as follows. That is, an unshown inverter included in the compressor operation control section 18 is controlled to apply a harmonic voltage to the motor 17 so that a stop position is detected from a current track. Then, in order to rotate the motor 17 forward by an electrical angle of 90°, the inverter is controlled to excite the motor 17 by DC current, and the inverter is controlled to apply a harmonic voltage to the motor 17 again, by which a stop position is detected from the resulting current track. Then, depending on whether or not a difference between the first- and second-time stop positions is equal to or lower than a specified threshold value, it is discriminated whether or not a lock has occurred (for more details, see JP 2004-132282 A). In addition, the technique for discriminating the lock of the compressor may otherwise be given by using, for example, the method described in JP 2000-197385 A or the like. As the method for discriminating the lock of the compressor, various methods are known and any one of them may be used. The step S46 forms an example of the starting-lock discriminating section.

If the starting-lock discriminating section discriminates that the compressor body 16 has locked, the control flow goes to step S47, where the starting power supplied to the motor 17 is increased, the flow returning to step S46. This step S47 forms an example of the starting-power increasing section, which increases the starting power to the motor 17.

At the step S47, the starting power is increased as shown in FIG. 13. That is, in the application of a voltage for start-up, if a lock of the compressor body 16 is decided on the way of the voltage increase to the set voltage Vsp for normal start-up (step S46), the starting power is increased gradually more than usual, the voltage increase being continued until the overcurrent protector (OCP) 67 is activated. After the motor 17 is stopped by the activation of the overcurrent protector (OCP) 67, the operation instruction for the compressor is kept off for a specified time, and then the start of the motor 17 is done again. This operation is repeated until it is discriminated that the compressor body 16 has not locked, i.e. that the compressor is in a non-locked state (step S47). Then, if it is discriminated that the compressor body 16 has not locked (step S46), then the control flow moves to the normal start-up control (step S44).

As shown above, the starting-power increasing section (step S47) repeats the operation including a step that the starting-lock discriminating section (step S46), if it has discriminated that the compressor body 16, i.e. the motor 17, has locked, increases the voltage to be applied to the motor 17 until the overcurrent protector 67 is activated, a step that the motor is stopped by the activation of the overcurrent protector 67, and a step that the starting operation is started again, which steps are repeated until the starting-lock discriminating section (step S6) discriminates that the compressor body 16 is not locked, i.e. the compressor is in a non-locked state.

Thus, since the operation of, upon a lock of the compressor body 16, increasing instantaneous electric power to be supplied to the motor 17 until the overcurrent protector 67 is activated, and increasing the starting torque of the motor 17 is repeated over and over again, the motor 17 can be started up with reliability even if the piston is locked to the cylinder by iced matters, so that starting failures can be prevented with reliability.

Further, in this third embodiment, since the voltage applied to the motor 17 is increased until the overcurrent protector 67 is activated, it becomes possible to increase the start-up voltage to an extreme and thereby increase the starting torque of the motor 17 to an extreme. Accordingly, starting failures due to iced matters can be prevented with reliability.

Also, in the third embodiment, if it is decided by the operation-stopped state deciding section (step S3) that the compressor body is stopped from operation in an elapse of a specified time after a stop of the defrosting operation of the air conditioner, i.e., if it is quite likely that solid iced matters have been generated, the starting-lock discriminating section (step S46) and the starting-power increasing section (step S47) are activated. Thus, the starting-lock discriminating section (step S46) and the starting-power increasing section (step S47) are kept from operating on unnecessary occasions, so that wasteful power consumption is eliminated.

It is noted that the operation-stopped state deciding section may be omitted.

Figure 14:
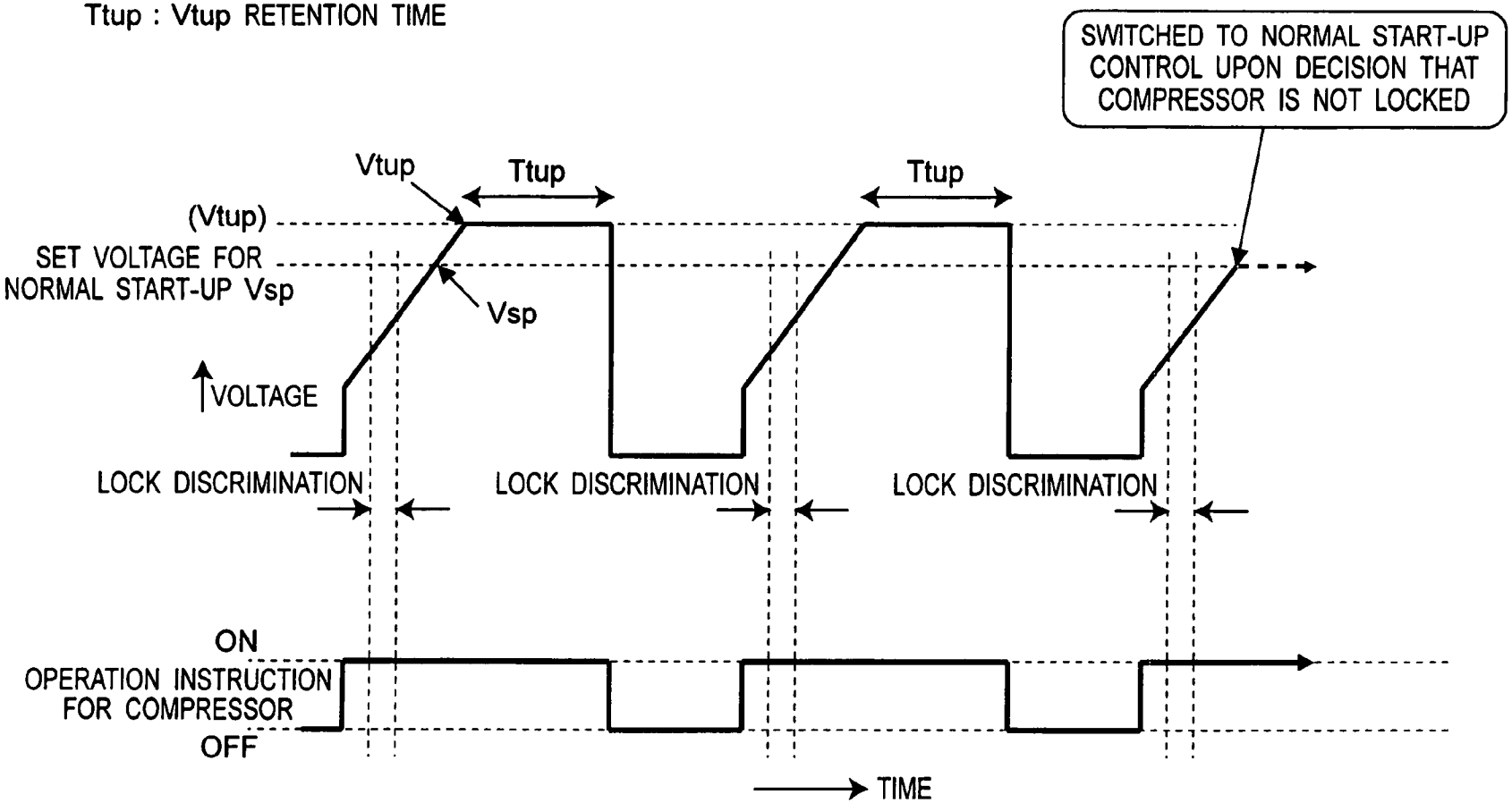
FIG. 14 a view for explaining operation of a modification of a starting-power increasing section.

FIG. 14 is a graph showing a modification of the starting-power increasing section. In this modification, in the voltage application to the motor 17 at a start-up, if a lock of the compressor body 16 is decided on the way of voltage increase to the set voltage Vsp for normal start-up (step S46), the starting-power increasing section boosts the voltage up to a preset boost voltage Vtup higher than the set voltage Vsp to increase the starting power more than usual, and sustains the boost voltage Vtup for a preset retention time Ttup, then keeps off the operation instruction of the compressor for a specified time, and thereafter performs the starting again. This operation is repeated until it is decided that the compressor body 16 is not locked, i.e., that the compressor is in a non-locked state. Then, if it is decided that the compressor body 16 is in a non-locked state (step S46), then the control flow moves to the normal start-up control (step S44).

It is noted that the preset boost voltage Vtup higher than the set voltage Vsp has a voltage value suitable for high load torque.

As shown above, the starting-power increasing section repeats the operation including a step of increasing the voltage applied to the motor 17, a step of, if it is decided by the starting-lock discriminating section (step S46) that the compressor body has locked, applying the preset boost voltage Vtup higher than the set voltage Vsp for normal start-up to the motor 17 for a preset retention time Ttup, and thereafter a step of, after a specified time of halt, starting the operation, where the operation is repeated until the starting-lock discriminating section (step S46) discriminates that the compressor body is not locked.

Thus, since the operation of, upon a lock of the compressor body 16, applying the boost voltage Vtup to the motor 17 for the preset retention time Ttup is repeated over and over again until it is decided that the compressor body 16 is in a non-locked state, the motor 17 can be started up with reliability even if the piston is locked to the cylinder by iced matters, so that starting failures can be prevented with reliability.

Figure 15:
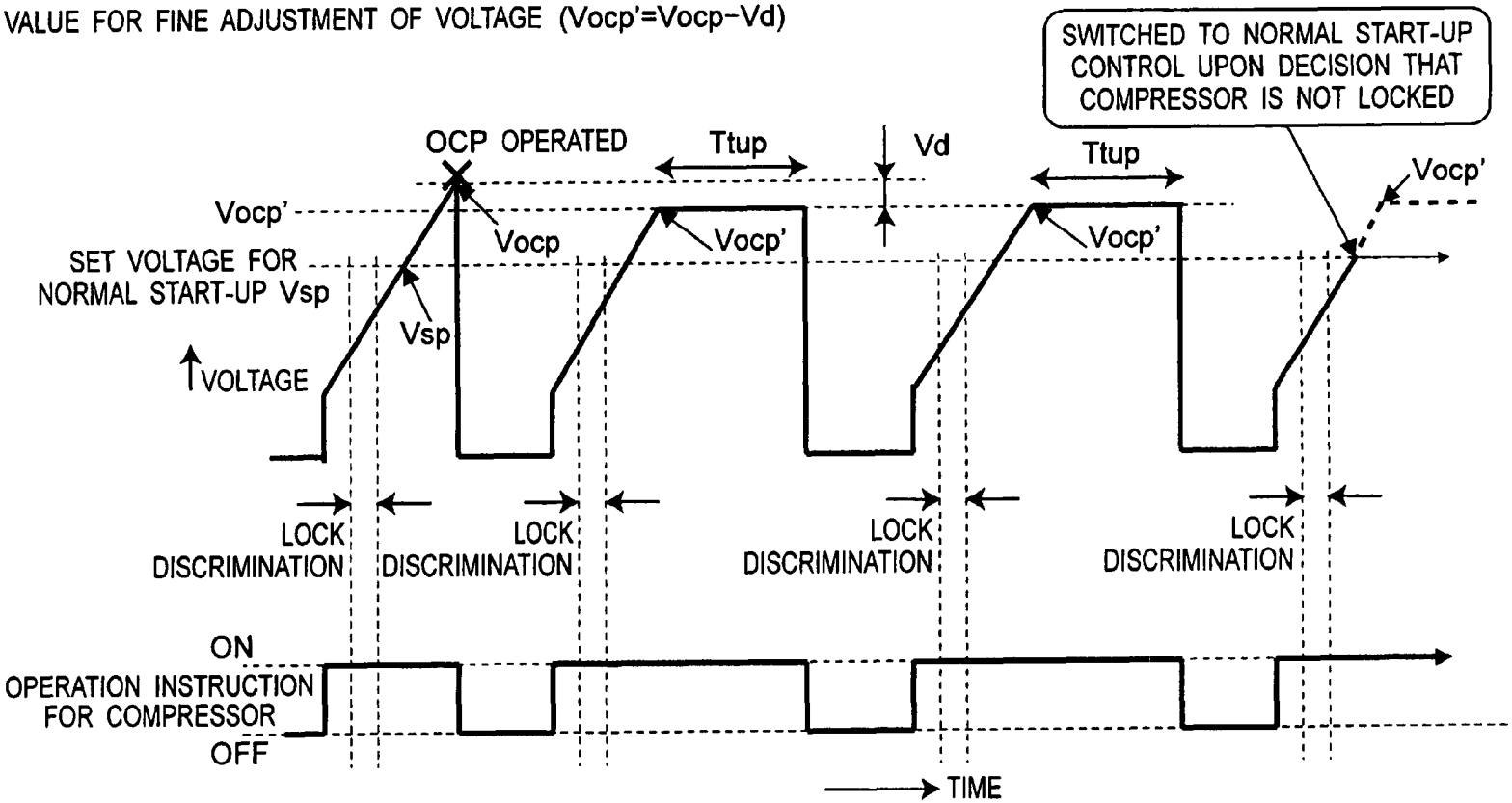
FIG. 15 is a view for explaining operation of a modification of a starting-power increasing section.

FIG. 15 is a graph showing another modification of the starting-power increasing section. In this modification, in the voltage application at a start-up, if a lock of the compressor body 16 is decided on the way of voltage increase to the set voltage Vsp for normal start-up (step S46), the starting-power increasing section performs a first operation including a step of gradually increasing the starting power more than usual, continuing the voltage increase up to an operating voltage Vocp on which the overcurrent protector (OCP) 67 operates, and a step of, after the conduction of the motor 17 is stopped by the operation of the overcurrent protector (OCP) 67, keeping off the operation instruction for the compressor for a specified time. Then, the operating voltage Vocp in the operation of the overcurrent protector (OCP) 67 or a value equivalent thereto is stored, and a value Vd for fine adjustment is subtracted from the operating voltage Vocp, by which a boost voltage Vocp' (Vocp'=Vocp−Vd) is calculated and stored. This boost voltage Vocp' is a voltage higher than the set voltage Vsp for normal start-up.

Next, in voltage application at a start-up, if a lock of the compressor body 16 is decided on the way of voltage increase to the set voltage Vsp for normal start-up (step S46), the starting-power increasing section performs a second operation including a step of boosting the voltage up to a boost voltage Vocp' higher than the set voltage Vsp and lower than the operating voltage Vocp to increase the starting power more than usual, a step of sustaining the boost voltage Vocp' for a preset retention time Ttup, a step of turning off the operation instruction of the compressor for a specified time, and thereafter a step of performing the starting again, where the second operation is repeated until it is decided that the compressor body 16 is not locked, i.e., that the compressor is in a non-locked state. Then, if it is discriminated that the compressor body 16 is in a non-locked state (step S46), then the control flow moves to the normal start-up control (step S44).

As shown above, the starting-power increasing section increases the voltage applied to the motor 17, and if it is discriminated by the starting-lock discriminating section that the compressor body has locked, performs the first operation for boosting the voltage applied to the motor up to the operating voltage Vocp until the overcurrent protector 67 is activated so that the motor is stopped, and thereafter boosts the voltage applied to the motor 17 again, and if it is discriminated by the starting-lock discriminating section (step S46) that the compressor body 16 has locked, performs the second operation for applying the preset boost voltage Vocp' higher than the set voltage Vsp for normal start-up to the motor 17 for the preset retention time Ttup, where the first operation and the second operation are repeated until the starting-lock discriminating section (step S46) discriminates that the compressor body 16 is not locked.

Thus, upon occurrence of a lock of the compressor body 16, the starting-power increasing section performs the first operation for increasing the instantaneous electric power supplied to the motor 17 up to the operating voltage Vocp, on which the overcurrent protector 67 is operated, and thereafter performs the second operation for applying the preset boost voltage Vocp' higher than the set voltage Vsp to the motor 17 for the preset retention time Ttup and thereafter stopping the operation instruction for the compressor, where the second operations are repeated over and over again until it is decided that the compressor body 16 is not locked. As a result, even if the piston is locked to the cylinder by iced matters, the motor 17 can be started up with reliability, so that starting failures can be prevented with reliability.

Figure 16:
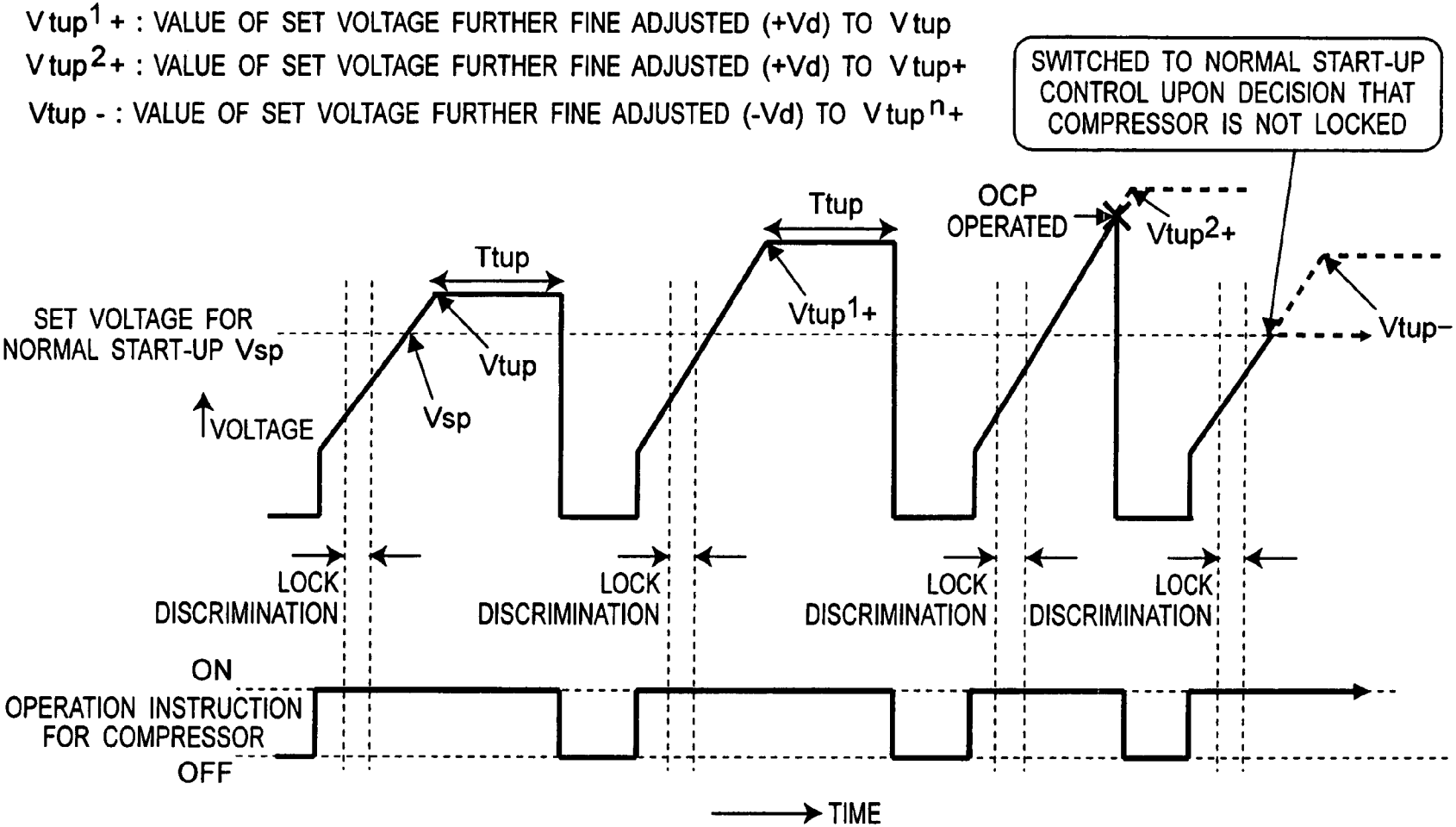
FIG. 16 is a view for explaining operation of a modification of a starting-power increasing section.

FIG. 16 is a graph showing another modification of the starting-power increasing section. In this modification, in the voltage application at a start-up, if a lock of the compressor body 16 is decided on the way of voltage increase to the set voltage Vsp for normal start-up (step S46), the starting-power increasing section boosts the voltage to a preset boost voltage Vtup higher than the set voltage Vsp to increase the starting power more than usual, sustaining the boost voltage Vtup for a preset retention time Ttup of, for example, several seconds, and thereafter keeps off the operation instruction for the compressor for a specified time. In this state, if the overcurrent protector 67 is not operated, an adjustment value Vd for fine adjustment of the boost voltage is added to the this-time boost voltage Vtup to determine and store a next-time boost voltage $Vtup^1$+ ($Vtup^1$+=Vtup+Vd).

Then, the starting-power increasing section performs the operation of increasing the voltage applied to the motor 17 again up to the boost voltage $Vtup^1$+, sustaining the voltage for the retention time Ttup, and thereafter keeping off the operation instruction for the compressor for a specified time. In this operation, a next-time boost voltage $Vtup^2+$ is calculated ($Vtup^2+=Vtup^1+Vd$).

That is, the boost voltage is increased stepwise successively as shown below, repeating a restart.

$$Vtup^1+=Vtup+Vd$$

$$Vtup^2+=Vtup^1++Vd$$

$$\ldots$$

$$Vtup^n+=Vtup^{1(n-1)}++Vd$$

where n represents a natural number of 2 or larger.

Now, on the way that the voltage applied to the motor 17 increases toward the boost voltage $Vtup^2+$, if the overcurrent protector 67 is operated, start-up is performed again by using, as a next-time boost voltage ($Vtup^-=Vtup^2+-Vd$), a voltage $Vtup^-$ obtained by subtracting the adjustment value Vd from the boost voltage $Vtup^2+$. Then, a sequence of operations are repeated until it is decided that compressor body 16 is not locked. Then, if it is discriminated that the compressor body 16 is not locked (step S46), the control flow moves to the normal start-up control (step S44).

As shown above, the starting-power increasing section, for repetition of start-up, increases successively the boost voltage applied to the motor 17 and moreover repeats the start-up over and over again until it is decided that the compressor body 16 is not locked. As a result, even if the piston is locked to the cylinder by iced matters, the motor 17 can be started up with reliability, so that starting failures can be prevented with reliability.

Figure 17:
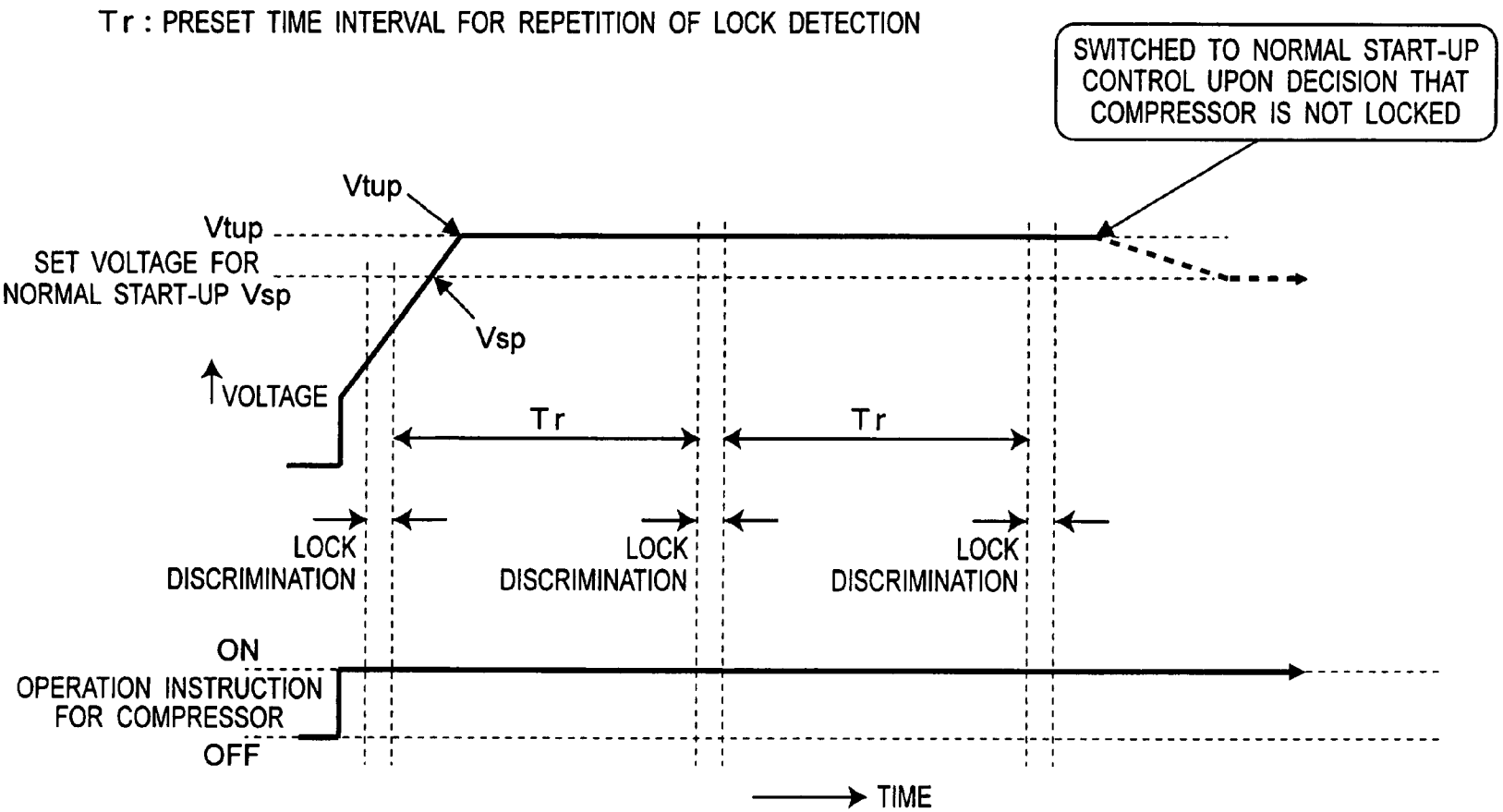
FIG. 17 is a view for explaining operation of a modification of a starting-power increasing section.

FIG. 17 is a graph showing a modification of the starting-power increasing section. In this modification, in the voltage application to the motor 17 at a start-up, if a lock of the compressor body 16 is decided on the way of voltage increase to the set voltage Vsp for normal start-up (step S46), the starting-power increasing section boosts the voltage to a preset boost voltage Vtup higher than the set voltage Vsp to increase the starting power more than usual. Then, while sustaining the boost voltage Vtup, the starting-power increasing section makes a decision as to the lock repeatedly in preset specified time intervals Tr between one lock decision and another lock decision, where this operating state is continued until it is decided that the compressor body 16 is not locked. Then, if it is decided that the compressor body 16 is not locked (step S46), then the control flow moves to the normal start-up control (step S44).

As shown above, if it is discriminated by the starting-lock discriminating section (step S46) that the compressor body has locked, the starting-power increasing section continues to apply to the motor 17 the preset boost voltage Vtup higher than the set voltage Vsp for normal start-up, and the starting-lock discriminating section (step S46) repeats the decision as to a lock of the piston at specified time intervals, where the starting-power increasing section continues the application of the boost voltage until the starting-lock discriminating section (step S46) discriminates that the compressor body is not locked.

Therefore, according to this modification, even if the piston is locked to the cylinder by iced matters, the motor 17 can be started up with reliability, so that starting failures can be prevented with reliability.

Figure 18:
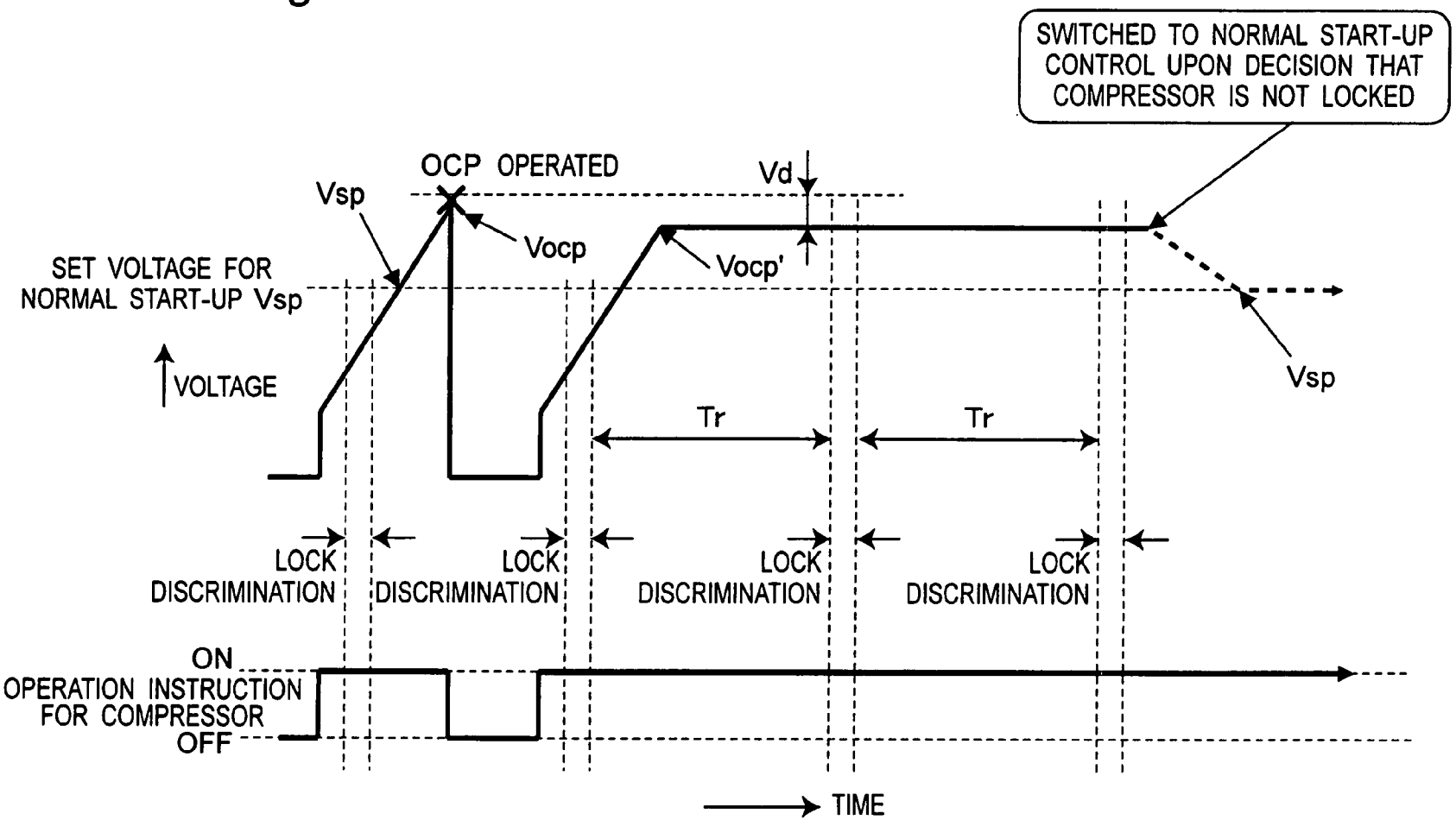
FIG. 18 is a view for explaining operation of a modification of a starting-power increasing section.

FIG. 18 is a graph showing a modification of the starting-power increasing section. In this modification, in the voltage application at a start-up, if a lock of the compressor body 16 is decided on the way of voltage increase to the set voltage Vsp for normal start-up (step S46), the starting-power increasing section performs a first operation including a step of increasing the starting power gradually more than usual, continuing the voltage increase up to an operating voltage Vocp on which the overcurrent protector (OCP) 67 operates, and a step of, after the conduction of the motor 17 is stopped by the operation of the overcurrent protector (OCP) 67, keeping off the operation instruction for the compressor for a specified time. Then, the operating voltage Vocp in the operation of the overcurrent protector (OCP) 67 or a value equivalent thereto is stored, and a value Vd for fine adjustment is subtracted from the operating voltage Vocp, by which a boost voltage Vocp' (Vocp'=Vocp−Vd) is calculated and stored. This boost voltage Vocp' is a voltage higher than the set voltage Vsp for normal start-up.

Next, in voltage application at a start-up, if a lock of the compressor body 16 is decided on the way of voltage increase to the set voltage Vsp for normal start-up (step S46), the starting-power increasing section boosts the voltage to a boost voltage Vocp' higher than the set voltage Vsp and lower than the operating voltage Vocp to increase the starting power more than usual. Then, while sustaining the boost voltage Vocp', the starting-lock discriminating section makes a decision as to the lock repeatedly in preset time intervals Tr between one lock decision and another lock decision, where this operating state is continued until it is decided that the compressor body 16 is not locked. Then, if it is decided that the compressor body 16 is not locked (step S46), then the control flow moves to the normal start-up control (step S44).

As shown above, the starting-power increasing section increases the voltage applied to the motor 17, and when it is discriminated by the starting-lock discriminating section (step S46) that the compressor body 16 has locked, the starting-power increasing section boosts the voltage applied to the motor 17 until the overcurrent protector 67 is operated so that the conduction of the motor 17 is stopped. Thereafter, when the it is discriminated by the starting-lock discriminating section (step S46) that the compressor body 16 has locked, the starting-power increasing section continues the application of the preset boost voltage Vocp' higher than the set voltage Vsp for normal start-up to the motor 17 again, where the starting-lock discriminating section (step S46) repeats the decision as to a lock of the compressor body 16 in specified time intervals Tr. The starting-power increasing section continues the application of the boost voltage until the starting-lock discriminating section (step S46) discriminates that the compressor body 16 is not locked.

Therefore, according to the starting-power increasing section of this modification, even if the piston is locked to the cylinder by iced matters, the motor 17 can be started up with reliability, so that starting failures can be prevented with reliability.

Figure 19:
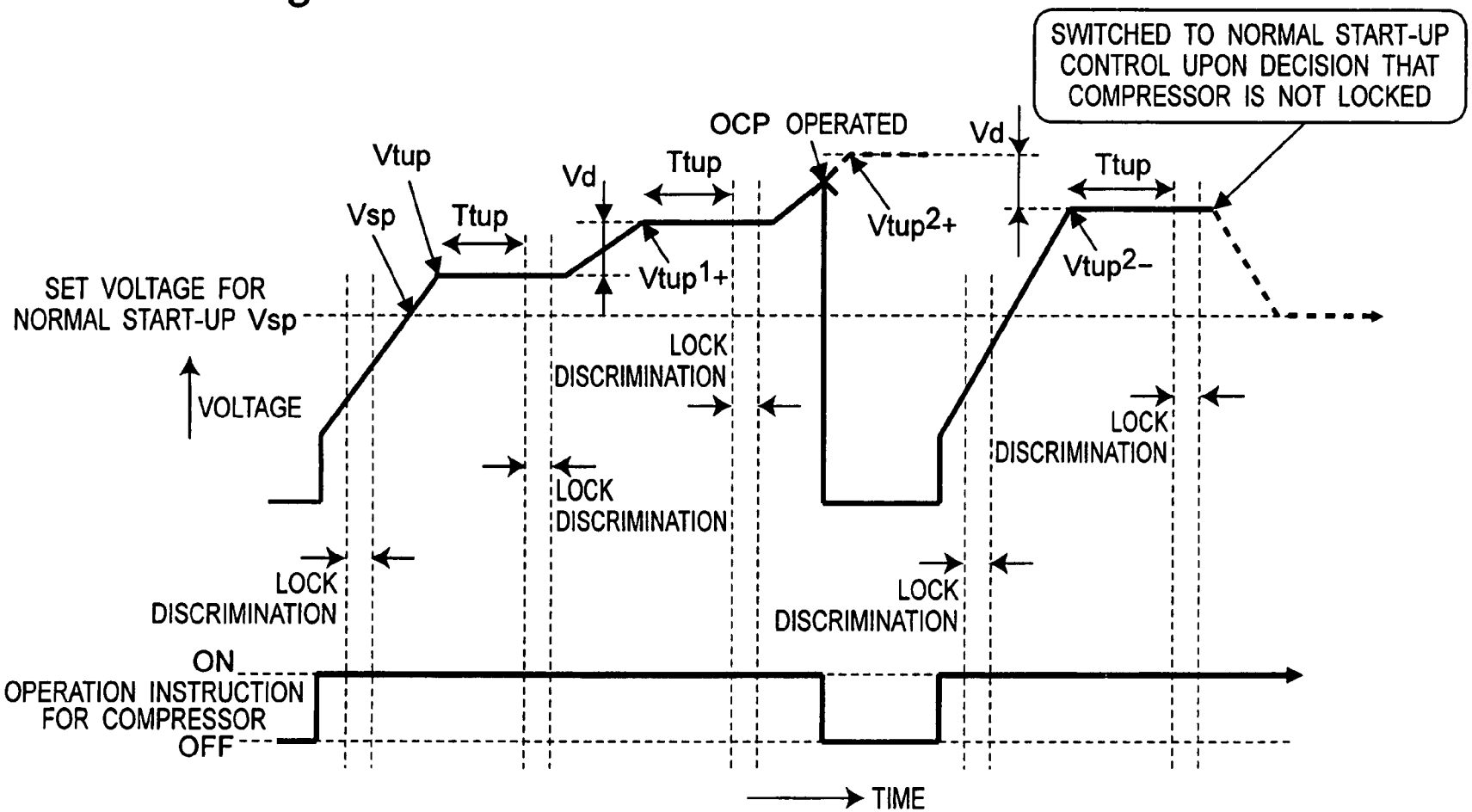
FIG. 19 is a view for explaining operation of a modification of a starting-power increasing section.

FIG. 19 is a graph showing another modification of the starting-power increasing section. In this modification, in the voltage application at a start-up, if a lock of the compressor body 16 is decided on the way of voltage increase to the set voltage Vsp for normal start-up (step S46), the starting-power increasing section performs operation for a specified time Ttup of, for example, several seconds with a preset boost voltage Vtup higher than the set voltage Vsp to increase the starting power more than usual. If the overcurrent protector 67 is not operated during the specified time Ttup, the starting-lock discriminating section makes a decision as to a lock thereafter again. If it is decided that the compressor body is locked, the starting-power increasing section adds an adjustment value Vd for fine adjustment of the boost voltage to the this-time boost voltage Vtup to determine a next-time boost voltage $Vtup^1+$, and then applies the boost voltage $Vtup^1+$ to the motor 17 during the specified time Ttup of several seconds. Further, if the overcurrent protector 67 is operated during the voltage increase to the boost voltage $Vtup^2+$ ($Vtup^2+=Vtup^1++Vd$), then the starting-power increasing section changes the boost voltage to a voltage value $Vtup^-$ obtained by subtracting the adjustment value Vd from the preceding boost voltage value $Vtup^2+$, and thereafter performs a start-up again, where the sequence of operations are repeated until it is decided that the compressor body 16 is not locked. Then, it is discriminated that the compressor body 16 is not locked (step S46), then the control flow moves to the normal start-up control (step S44).

As shown above, when the starting-lock discriminating section (step S46) discriminates that the compressor body 16 has locked, the starting-power increasing section repeats the operation including the steps of applying preset boost voltages $Vtup^1+$, $Vtup^2+$higher than the set voltage Vsp for normal start-up to the motor 17, and increasing the boost voltages $Vtup^1+$, $Vtup^2+$stepwise each time the starting-lock discriminating section (step S46) repeats the decision as to a lock of the compressor body 16 in specified time intervals, until the starting-lock discriminating section (step S46) discriminates that the compressor body 16 is not locked, or until the overcurrent protector 67 is operated so that the conduction of the motor is stopped.

Therefore, according to the starting-power increasing section of this modification, even if the piston is locked to the cylinder by iced matters, the motor 17 can be started up with reliability, so that starting failures can be prevented with reliability.

Fourth Embodiment

A compressor of this fourth embodiment is so designed that after a stop of the compressor body under certain conditions, upon occurrence of a lock of the compressor body at a start-up, a current for heat generation is passed through the motor to increase the internal temperature of the compressor body by generated heat energy with a view to improving the starting performance of the compressor body, based on a concept that the piston and the cylinder of the compressor body are locked by iced matters.

A block diagram of the compressor of this fourth embodiment is similar to FIG. 11 of the third embodiment, and so FIG. 11 is used in common. The software of this compressor is represented by a flowchart of FIG. 20.

Figure 20:
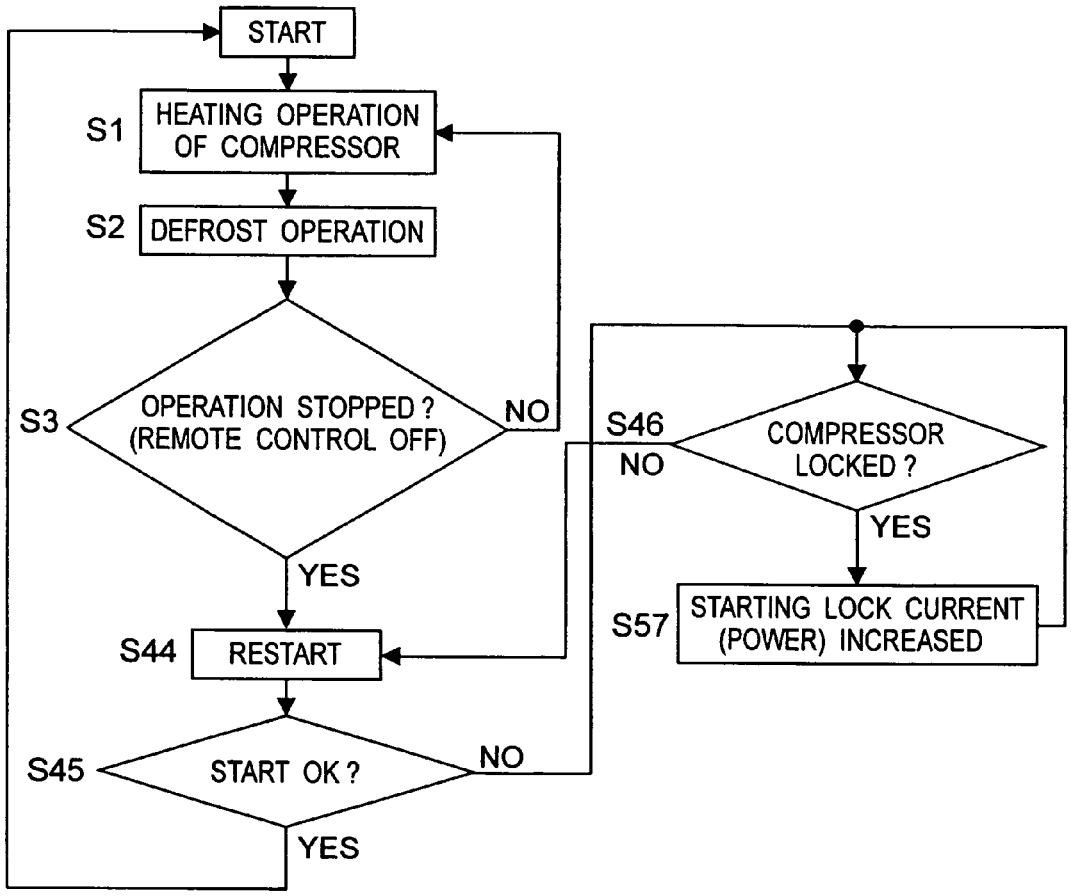
FIG. 20 is a flowchart representing control on a compressor of a fourth embodiment.

In FIG. 20, steps S1, S2, S3, S44, S45 and S46 are identical in operations to those of the third embodiment shown in FIG. 12, and so designated by like reference numerals, and their detailed description is omitted.

The compressor of the fourth embodiment shown in FIG. 20 differs from the compressor of the third embodiment shown in FIG. 12 in that instead of the starting-power increasing section (step S47), a heat-generation current control section (step S57) is provided to control a current (hereinafter, referred to as lock current) for the motor 17 so as to generate heat from the motor 17 upon occurrence of a lock of the compressor body 16.

The compressor of this fourth embodiment also, as in the compressor of the third embodiment, includes an icing-lock preventing section. However, the icing-lock preventing section of the fourth embodiment includes an operation-stopped state deciding section (step S3) for deciding whether or not operation of the compressor body has been stopped in an elapse of a specified time after a stop of defrosting operation, a starting-lock discriminating section (step S46) for deciding whether or not the compressor body 16 has been locked at a start-up, and a heat-generation current control section (step S57) for, if the starting-lock discriminating section (step S46) discriminates that the compressor body 16 has locked, controlling the lock current for the motor 17 to generate heat from the motor 17. The operation-stopped state deciding section (step S3) and the starting-lock discriminating section (step S46) are identical to those of the compressor of the third embodiment and so their description is omitted.

Figure 22:
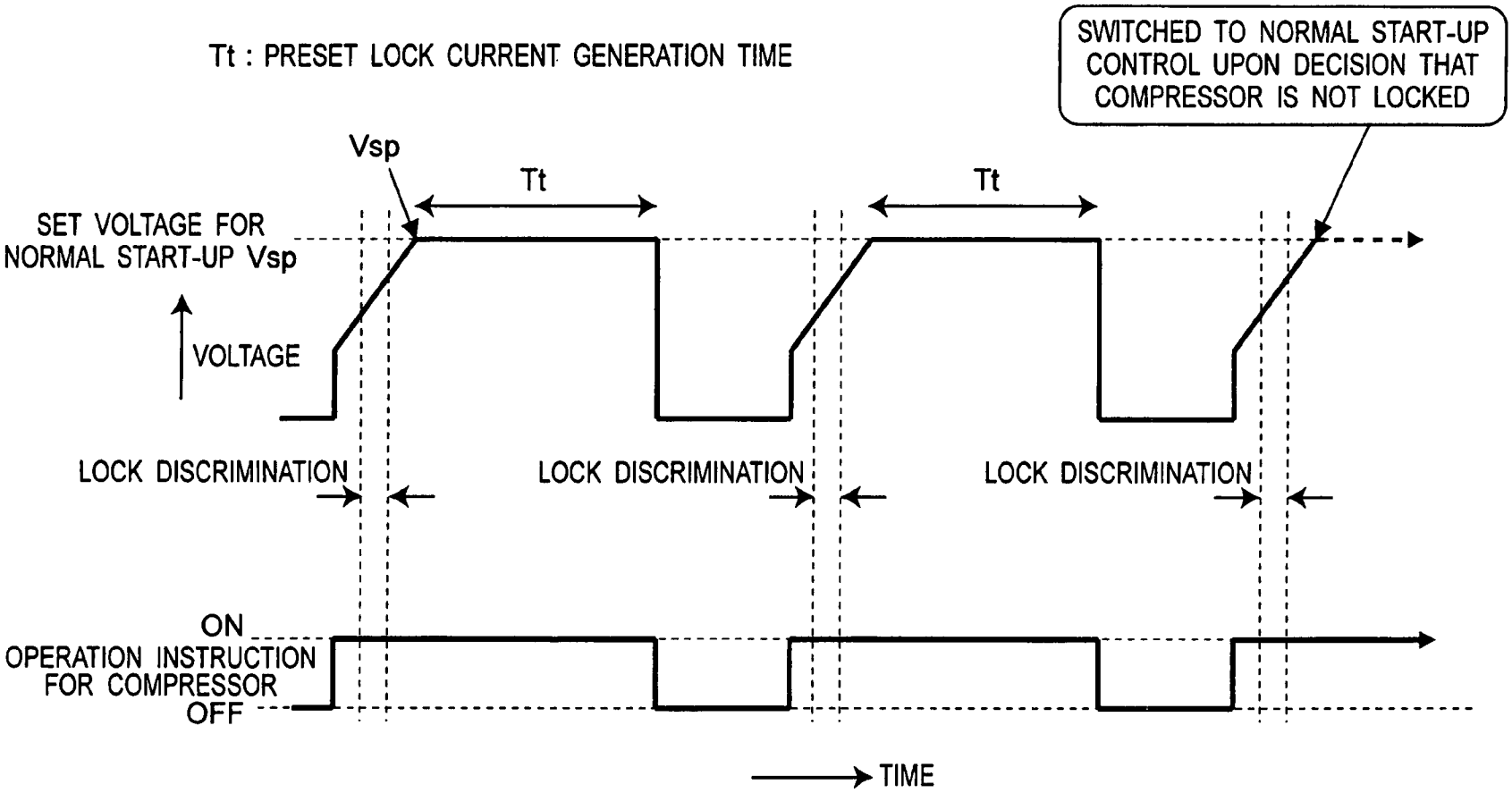
FIG. 22 is a view for explaining operation of a current control section of the compressor.

The heat-generation current control section (step S57) operates as shown in FIG. 22. That is, in voltage application to the motor 17 at a start-up, if a lock of the compressor body 16 is decided on the way of voltage increase to the set voltage Vsp for normal start-up (step S46), the heat-generation current control section performs an operation for generating a lock current while retaining the set voltage Vsp for a preset time Tt. Then, after keeping off the operation instruction for the compressor for a specified time, the heat-generation current control section repeats the above operation again until it is decided that the compressor body 16 is not locked. Then, if it is decided that the compressor body 16 is not locked (step S46), then the control flow moves to the normal start-up control (step S44).

As shown above, upon a lock of the compressor body 16, in order to melt the iced matters between the cylinder and the piston, the operation of passing the lock current to the motor 17 is repeated over and over again until it is decided that the compressor body 16 is not locked. Therefore, even if the piston is locked to the cylinder by iced matters, the motor 17 can be started up with reliability, so that starting failures can be prevented with reliability.

Figure 21:
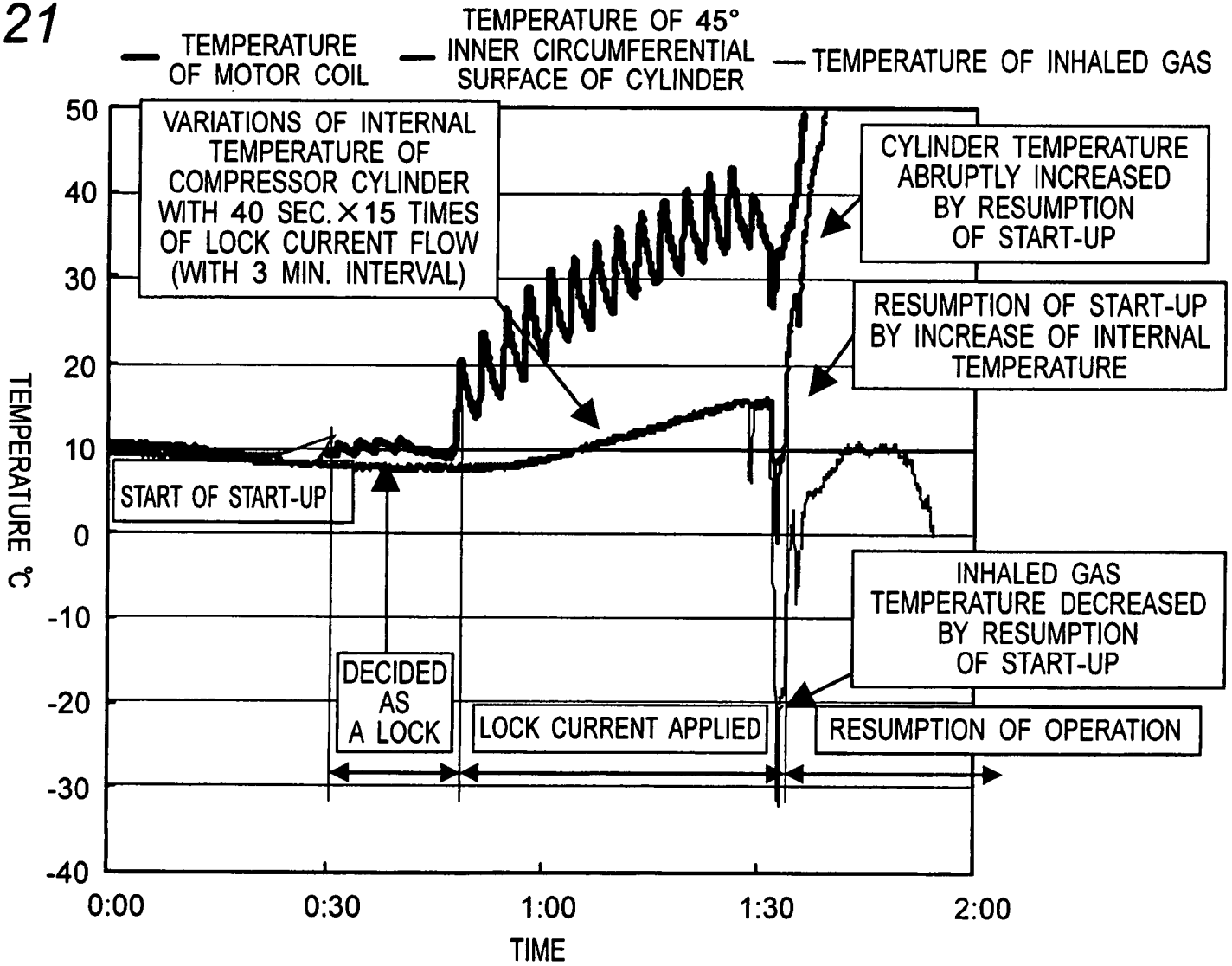
FIG. 21 is a graph representing measured values of temperature variations inside the compressor.

FIG. 21 is a graph representing measured data resulting in a case where 40-second conduction of the motor with the lock current is repeated at three-minute intervals to 15 times. FIG. 21 represents a relationship and time variations among coil temperature of the motor 17, temperature of a site of 45° from the blade toward the moving direction of the piston in the compressor body 16, and temperature of inhaled gas.

From FIG. 21, it can be understood the temperature of the 45° site of the cylinder is increased by the lock current.

Figure 23:
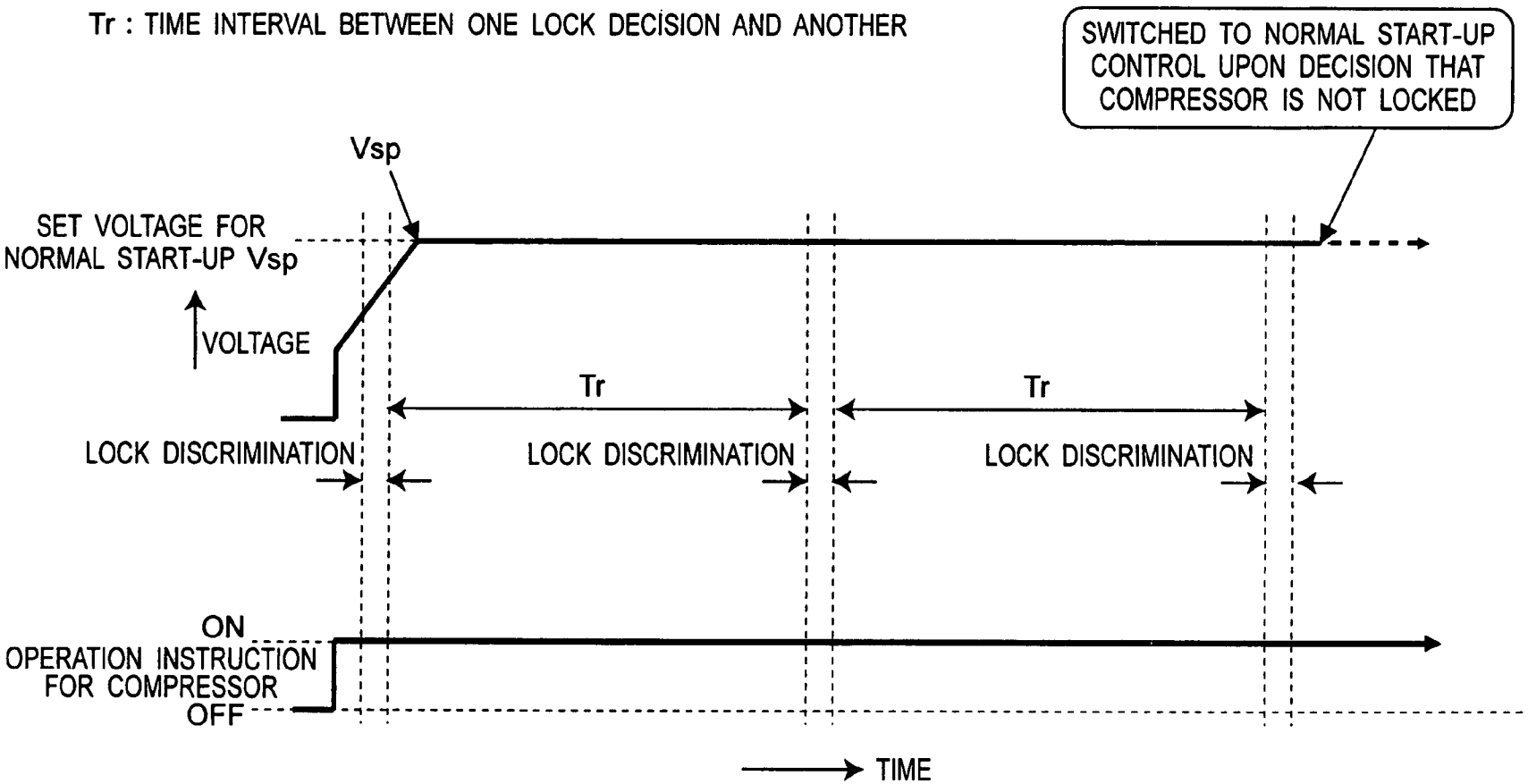
FIG. 23 is a view for explaining operation of a modification of the current control section.

FIG. 23 is a graph showing a modification of the heat-generation current control section (step S57). In this modification, in the voltage application to the motor 17 at a start-up, if a lock of the compressor body 16 is decided on the way of voltage increase to the set voltage Vsp for normal start-up (step S46), the heat-generation current control section continues passing a lock current to the motor while retaining the set voltage Vsp. Then, the starting-lock discriminating section makes a decision as to the lock repeatedly in preset time intervals Tr between one lock decision and another lock decision, where this operating state is continued until it is decided that the compressor body 16 is not locked. Then, if it is decided that the compressor body 16 is not locked (step S46), then the control flow moves to the normal start-up control (step S44).

As shown above, when it is discriminated by the starting-lock discriminating section (step S46) that the compressor body 16 has locked, the heat-generation current control section (step S57) continues the voltage application of the set voltage Vsp for normal start-up to the motor 17, where the starting-lock discriminating section (step S46) repeats the decision as to the lock in specified time intervals until it is discriminated by the starting-lock discriminating section (step S46) that the compressor body is not locked.

Therefore, according to this modification, even if the piston is locked to the cylinder by iced matters, the motor 17 can be started up with reliability, so that starting failures can be prevented with reliability.

Fifth Embodiment

A compressor of the fifth embodiment is so designed that upon occurrence of a lock of the compressor body at a start-up, a current is passed through a heater for heating of the compressor body to generate heat from the heater and thereby increase the internal temperature of the compressor body by the generated heat energy from the heater, based on a concept that the piston and the cylinder of the compressor body are locked by iced matters, with a view to improving the starting performance of the compressor body.

The compressor of the fifth embodiment, although not shown, includes a heater for heating of the compressor body 16 in addition to FIG. 11 of the third embodiment. Therefore, FIG. 11 is used here in common.

Also, the flowchart of control for the compressor of the fifth embodiment differs from the flowchart of the compressor of the fourth embodiment shown in FIG. 20 in that a heat-generation current control section for controlling the current to the heater for generation of heat from the heater to heat the compressor body 16 at a lock of the compressor body 16 is provided instead of the heat-generation current control section (step S57) for control of the lock current to the motor. Otherwise, the compressor is similar thereto, and so FIG. 20 is used in common for common steps.

The compressor of the fifth embodiment also, as in the compressor of the fourth embodiment, includes an icing-lock preventing section. However, the icing-lock preventing section of the fifth embodiment includes an operation-stopped state deciding section (step S3) for deciding whether or not operation of the compressor body has been stopped in an elapse of a specified time after a stop of defrosting operation, a starting-lock discriminating section (step S46) for deciding whether or not the compressor body 16 has been locked at a start-up, and a heat-generation current control section for, if the starting-lock discriminating section (step S46) discriminates that the compressor body 16 has locked, controlling the current for the heater to generate heat from the heater. The operation-stopped state deciding section (step S3) and the starting-lock discriminating section (step S46) are identical to those of the compressors of the third and fourth embodiments and so their description is omitted.

According to the fifth embodiment, upon a lock of the compressor body 16, in order to melt the iced matters between the cylinder and the piston, a current is passed through the heater. Therefore, even if the piston is locked to the cylinder by iced matters, the motor 17 can be started up with reliability, so that starting failures can be prevented with reliability.

The first to fifth embodiments have been described on a swing type compressor in which a piston and a blade are integrated together. However, needless to say, the present invention is applicable also to rotary type compressors in which a piston and a blade are provided independently of each other and in relative motion to each other.

Further, the icing-lock preventing section includes a crystal growth inhibiting section in the first embodiment, the icing-lock preventing section includes a piston-stop-position control section in the second embodiment, the icing-lock preventing section includes a starting-power increasing section in the third embodiment, the icing-lock preventing section includes a heat-generation current control section for controlling the lock current to the motor in the fourth embodiment, and the icing-lock preventing section includes a heat-generation current control section for controlling the current to the heater in the fifth embodiment. However, in one compressor, the icing-lock preventing section may include at least two out of the crystal growth inhibiting section, the piston-stop-position control section, the starting-power increasing section, the heat-generation current control section for controlling the lock current to the motor, and the heat-generation current control section for controlling the current to the heater. In this case, the lock due to iced matters can be prevented with higher reliability.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A compressor comprising:

a compressor body in which a cylinder chamber formed in a cylinder is divided into a compression chamber and a suction chamber by a piston and a blade, the compression chamber having a discharge port opened and the suction chamber having a suction port opened;

a motor for driving the piston; and an icing-lock preventing section for preventing a lock of the piston due to iced matters generated and grown between an inner surface of the cylinder chamber and the piston.

2. The compressor as claimed in claim 1, wherein the piston and the blade are integrally fixed, and the piston is a swing type one which works in swing motion.

3. The compressor as claimed in claim 1, wherein the icing-lock preventing section includes a crystal growth inhibiting section for inhibiting growth of frost or ice crystals generated within the cylinder chamber.

4. The compressor as claimed in claim 3, wherein the crystal growth inhibiting section includes:

an operation-stopped state deciding section for deciding whether or not operation of the compressor body has been stopped in an elapse of a specified time after a stop of defrosting operation of an air conditioner; and a following-operation-of-compressor control section for, when it is decided by the operation-stopped state deciding section that operation of the compressor body has been stopped, controlling the motor so that the compressor body is forcedly operated for a specified time.

5. An air conditioner comprising:

a refrigerant circuit in which the compressor as defined in claim 4, a four-way switching valve, an indoor heat exchanger, an expansion section, an outdoor heat exchanger, the four-way switching valve and the compressor are connected in order to one another; and a following-operation-of-air-conditioner control section for, while the following-operation-of-compressor control section is working for following operation of the compressor, controlling the four-way switching valve so as to perform heating operation and controlling at least a fan of the indoor heat exchanger to stop the fan.

6. The compressor as claimed in claim 1, wherein the icing-lock preventing section includes a piston-stop-position control section for controlling a stop position of the piston so that the piston is stopped in a high-temperature region other than low-temperature regions of an inner circumferential surface of the cylinder where frost or ice is easily generated.

7. The compressor as claimed in claim 6, wherein the high-temperature region is a region including a region of the inner circumferential surface of the cylinder between the blade and the suction port, and a region of the inner circumferential surface of the cylinder ranging from 180° to 360° from the blade toward a moving direction of the piston about a center of the cylinder chamber.

8. The compressor as claimed in claim 6, wherein the high-temperature region is a region of the inner circumferential surface of the cylinder ranging from 180° to 360° from the blade toward a moving direction of the piston about a center of the cylinder chamber.

9. The compressor as claimed in claim 6, wherein the low-temperature region is a region of the inner circumferential surface of the cylinder between the suction port and a site of 180° from the blade toward a moving direction of the piston about a center of the cylinder chamber, and the piston-stop-position control section stops the piston in the high-temperature region so that a clearance between the inner circumferential surface of the cylinder and the piston becomes not less than 500 μm in the low-temperature region.

10. The compressor as claimed in claim 6, further comprising a stop instruction deciding section for deciding whether or not a stop instruction for stopping operation of the compressor body has been outputted during defrost operation of the air conditioner or within a specified time after a return to heating operation from the defrost operation, wherein the piston-stop-position control section controls a stop position of the piston, when it is decided by the stop instruction deciding section that the stop instruction has been outputted.

11. The compressor as claimed in claim 1, wherein the icing-lock preventing section includes:

a starting-lock discriminating section for deciding whether or not the compressor body has locked at a start-up; and a starting-power increasing section for, when it is discriminated by the starting-lock discriminating section that the compressor body has locked, increasing supply power to the motor.

12. The compressor as claimed in claim 11, wherein the icing-lock preventing section further includes:

an operation-stopped state deciding section for deciding whether or not operation of the compressor body has been stopped in an elapse of a specified time after a stop of defrosting operation of an air conditioner, and the starting-lock discriminating section decides whether or not the compressor body has locked at a restart, when the operation-stopped state deciding section decides that operation of the compressor body has been stopped.

13. The compressor as claimed in claim 11, further comprising an overcurrent protector for preventing any overcurrent of the motor, wherein when it is discriminated by the starting-lock discriminating section that the compressor body has locked, the starting-power increasing section repeats an operation including steps of boosting a voltage applied to the motor until the overcurrent protector is operated, and after the motor is stopped by operation of the overcurrent protector, boosting the voltage applied to the motor again to an operating voltage on which the overcurrent protector is operated, where the operation is repeated until the starting-lock discriminating section discriminates that the compressor body is not locked.

14. The compressor as claimed in claim 11, wherein when it is discriminated by the starting-lock discriminating section that the compressor body has locked, the starting-power increasing section repeats an operation of applying to the motor a preset boost voltage higher than a set voltage for normal start-up for a preset retention time, where the operation is repeated until the starting-lock discriminating section discriminates that the compressor body is not locked.

15. The compressor as claimed in claim 14, wherein the starting-power increasing section increases the boost voltage as the operation is repeated.

16. The compressor as claimed in claim 15, further comprising an overcurrent protector for preventing any overcurrent of the motor, wherein the starting-power increasing section repeats the operation until the overcurrent protector is operated.

17. The compressor as claimed in claim 11, further comprising an overcurrent protector for preventing any overcurrent of the motor, wherein when it is discriminated by the starting-lock discriminating section that the compressor body has locked, the starting-power increasing section performs a first operation of increasing a voltage applied to the motor to an operating voltage on which the overcurrent protector is operated, and thereafter a second operation of boosting the voltage applied to the motor again and, upon discrimination by the starting-lock discriminating section that the compressor body has locked, applying to the motor a preset boost voltage higher than a set voltage for normal start-up and lower than the operating voltage for a preset retention time, where the second operation is repeated until the starting-lock discriminating section discriminates that the compressor body is not locked.

18. The compressor as claimed in claim 11, wherein when it is discriminated by the starting-lock discriminating section that the compressor body has locked, the starting-power increasing section continues applying to the motor a preset boost voltage higher than a set voltage for normal start-up, the starting-lock discriminating section repeats a decision as to a lock of the piston in specified time intervals, and the starting-power increasing section continues application of the boost voltage until the starting-lock discriminating section discriminates that the compressor body is not locked.

19. The compressor as claimed in claim 11, further comprising an overcurrent protector for preventing any overcurrent of the motor, wherein the starting-power increasing section increases a voltage applied to the motor, and upon a discrimination by the starting-lock discriminating section that the compressor body has locked, boosts the voltage applied to the motor up to an operating voltage on which the overcurrent protector is operated so that conduction of the motor is stopped, and thereafter again when it is discriminated by the starting-lock discriminating section that the compressor body has locked, the starting-power increasing section continues applying to the motor a preset boost voltage higher than a set voltage for normal start-up and lower than the operating voltage, the starting-lock discriminating section repeats a decision as to a lock of the piston in specified time intervals, and the starting-power increasing section continues application of the boost voltage until the starting-lock discriminating section discriminates that the compressor body is not locked.

20. The compressor as claimed in claim 11, further comprising an overcurrent protector for preventing any overcurrent of the motor, wherein when it is discriminated by the starting-lock discriminating section that the compressor body has locked, the starting-power increasing section applies to the motor a preset boost voltage higher than a set voltage for normal start-up, and performs an operation of increasing the boost voltage stepwise each time the starting-lock discriminating section repeats the decision as to a lock of the compressor body in specified time intervals, where the operation is repeated until the starting-lock discriminating section discriminates that the compressor body is not locked, or until the overcurrent protector is operated so that the conduction of the motor is stopped.

21. The compressor as claimed in claim 1, wherein the icing-lock preventing section includes:

a starting-lock discriminating section for deciding whether or not the compressor body has locked at a start-up; and a heat-generation current control section for, when it is discriminated by the starting-lock discriminating section that the compressor body has locked, controlling a current to the motor to generate heat from the motor.

22. The compressor as claimed in claim 21, wherein the icing-lock preventing section further includes an operation-stopped state deciding section for deciding whether or not operation of the compressor body has been stopped in an elapse of a specified time after a stop of defrosting operation of an air conditioner, wherein when it is decided by the operation-stopped state deciding section that the compressor body has been stopped, the starting-lock discriminating section decides whether or not the compressor body has locked at a restart.

23. The compressor as claimed in claim 21, wherein when it is discriminated by the starting-lock discriminating section that the compressor body has locked, the heat-generation current control section repeats an operation of applying to the motor a set voltage for normal start-up for a preset retention time until the starting-lock discriminating section discriminates that the compressor body is not locked.

24. The compressor as claimed in claim 21, wherein when it is discriminated by the starting-lock discriminating section that the compressor body has locked, the heat-generation current control section continues applying to the motor a set voltage for normal start-up, the starting-lock discriminating section repeats a decision as to a lock of the compressor body in specified time intervals, and the heat-generation current control section continues application of the set voltage until the starting-lock discriminating section discriminates that the compressor body is not locked.

25. The compressor as claimed in claim 1, wherein the icing-lock preventing section includes:

a heater for heating the compressor body;

a starting-lock discriminating section for deciding whether or not the compressor body has locked at a start-up; and a heat-generation current control section for, when it is discriminated by the starting-lock discriminating section that the compressor body has locked, controlling a current to the heater to generate heat from the heater.

26. The compressor as claimed in claim 25, wherein the icing-lock preventing section further includes an operation-stopped state deciding section for deciding whether or not operation of the compressor body has been stopped in an elapse of a specified time after a stop of defrosting operation of an air conditioner, wherein when it is decided by the operation-stopped state deciding section that operation of the compressor body has been stopped, the starting-lock discriminating section decides whether or not the compressor body has locked at a restart.

* * * * *